US005250396A

United States Patent [19]

Ueda et al.

[11] Patent Number: 5,250,396

[45] Date of Patent: Oct. 5, 1993

[54] METHOD FOR PROCESSING SILVER HALIDE COLOR PHOTOGRAPHIC MATERIAL

[75] Inventors: Shinji Ueda; Takatoshi Ishikawa; Hiroshi Fujimoto, all of Kanagawa, Japan

[73] Assignee: Fuji Photo Film Co., Ltd., Kanagawa, Japan

[21] Appl. No.: 954,411

[22] Filed: Sep. 30, 1992

Related U.S. Application Data

[63] Continuation of Ser. No. 704,651, May 30, 1991, abandoned, which is a continuation of Ser. No. 299,577, Jan. 23, 1989, abandoned.

[30] Foreign Application Priority Data

Jan. 21, 1988 [JP] Japan ..... 63-11300

[51] Int. Cl.[5] ..... G03C 7/30

[52] U.S. Cl. ..... 430/357; 430/398; 430/439; 430/484; 430/486; 430/490

[58] Field of Search ..... 430/357, 398, 434, 435, 430/439, 484, 486, 490

[56] References Cited

U.S. PATENT DOCUMENTS

| | | | |
|---|---|---|---|
| 4,228,234 | 10/1980 | Okutsu et al. | 430/399 |
| 4,613,562 | 9/1986 | Kuse et al. | 430/399 |
| 4,791,048 | 12/1988 | Hirai et al. | 430/372 |
| 4,801,521 | 1/1989 | Ohki et al. | 430/464 |
| 4,853,318 | 8/1989 | Fujita et al. | 430/380 |

*Primary Examiner*—Hoa V. Le

*Attorney, Agent, or Firm*—Sughrue, Mion, Zinn, Macpeak & Seas

[57] ABSTRACT

A method of continuously processing an imagewise exposed silver halide photographic material using an automatic processor which has a color development bath, comprising the steps of a) developing with a color developer containing an organic preservative, and b) adding to the color developer during the continuous processing (i) a replenisher for the color developer containing a development agent and other components for the development in an amount of from 20 ml to 600 ml per $m^2$ of the photographic material processed, and (ii) a water solution in an amount of from 0.1 to 1.2 times the amount of the developer which has evaporated from the bath at a frequency of about once per week or more often.

23 Claims, No Drawings

METHOD FOR PROCESSING SILVER HALIDE COLOR PHOTOGRAPHIC MATERIAL

This is a continuation of application Ser. No. 07/704,651 filed May 30, 1991, now abandoned, which is a continuation of application Ser. No. 07/299,577 filed Jan. 23, 1989, abandoned.

FIELD OF THE INVENTION

This invention relates to a method for processing silver halide color photographic materials, which method provides good photographic performance and can be easily carried out with low deviation in image quality.

BACKGROUND OF THE INVENTION

In processing silver halide color photographic materials to provide stable photographic images having good photographic performance, it has recently been keenly desired to maintain a high level of photographic performance throughout continuous processing. To maintain a high level of performance, two problems must be solved. The first problem is that the components of processing solutions are reduced by air oxidation, thermal decomposition, etc., and such reduction diminishes the performances of the processing solutions. The second problem is that in the case of continuously processing color photographic materials using an automatic processor, the processing solutions are concentrated by evaporation. Such concentration diminishes the performance of the processing solutions and can cause the problem of the components of the processing solution being deposited on a wall of the processing bath at vicinity of the liquid surface.

Preservatives for color developers have been investigated as a means to solve the problems of the occurrence of air oxidation and thermal decomposition of the color developing agent. Such preservatives are described in JP-A-62-215272 (the term "JP-A" a used herein means an "unexamined published Japanese patent application"). Particularly effective organic preservatives are, for example, substituted hydroxyamines (i.e., excluding the unsubstituted hydroxyamine), hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamino compounds, condensed ring-type amines, etc. These compounds are disclosed in JP-A-63-4235 JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-170642, JP-A-63-44657 and JP-A-63-44656, U.S. Pat. Nos. 3,615,503 and 2,494,903, JP-A-52-143020, and JP-B-48-30496. (The term "JP-B" as used herein means an "examined published Japanese patent application").

By using the aforesaid organic preservatives such as substituted hydroxylamines, etc., the deterioration or reduction of the color developing agent can be greatly inhibited as compared to the case of using hydroxylamine or a sulfite as a preservative. However, this solution to the first problem (deterioration or reduction of the developing agent) leaves unsolved the second problem (the evaporation of the processing solution). Both problems must be solved in order to further stabilize photographic processing.

SUMMARY OF THE INVENTION

An object of the present invention is to provide a simplified method for continuously processing silver halide color photographic materials to provide good and stable photographic properties.

To attain this object, the present invention provides a method of continuously processing imagewise exposed silver halide color photographic materials using an automatic processor which has a color development bath, which comprises the steps of a) using a color developer which contains an organic preservative and b) adding to the color developer during the continuous processing either a water replenisher solution or a stabilizer solution instead of wash water.

DETAILED DESCRIPTION OF THE INVENTION

As described above, in photographic processing it is necessary to solve both the problem of deterioration/reduction of the developing agent as well as the problem of evaporation of the processing solution. As the result of various investigations into performing the photographic processing while adding either water or a stabilizer to the color developer, it has been discovered that it is difficult to determine suitable concentrations of each component of the color developer. In particular, it is difficult to determine the concentration of the preservative which is used in the color developer. Moreover, use of unsuitable concentrations of the processing solution and of the water being added in continuous processing causes an unacceptable deviation in photographic properties. However, it has also been discovered that this deviation of the photographic performance is greatly inhibited by using one of the above-mentioned organic preservatives in the present invention. Thus, present invention permits photographic processing to be performed while using only a small amount of supplementory processing solution to compensate for the processing solution lost due to evaporation.

This accomplishment of the present invention is quite useful because when a replenisher solution is added to the color developer to compensate for evaporation, it is very convenient to use either the replenisher for the wash water or the replenisher for the stabilizer instead of wash water in the continuous photographic processing. This use of replenishers instead of wash water enhances convenience by making it unnecessary to use an additional tank and conduits for adding water to the color developer when compensation for loss due to evaporation. Furthermore, when the replenisher for the wash water or the replenisher for the stabilizer is used instead of the wash water to compensate for lost color developer, it is preferred to minimize the amount of a) the replenisher for the wash water in the wash bath or b) the replenisher for the stabilizer in the stabilization bath. This is particularly true in a small sized automatic processor wherein the replenisher tanks and the processing section are formed in the processor's body.

According to the present invention, the amount of water added to the color developer is preferably from 0.1 to 1.2 times the amount of the developer which has evaporated from the color development bath of an automatic processor. Regardless of the frequency of addition, the amount of water added is preferably from 0.3 to 0.9 times the amount of developer which has evaporated.

Furthermore, the frequency at which water is added to the color developer may be about once per week, but adding water more than once per day is particularly preferred. Also, it is particularly preferred that before any interruption in the operation of the automatic processor (e.g., at night or during a holiday), the amount of the color developer which is expected to evaporate during the interruption is estimated. Then, from the estimate are can calculated the amount of replenisher solution required to compensate for evaporation, and the correct amount can be added to the developer prior to the interruption.

It is preferable to minimize the amount of processing solution which evaporates since in the case of using the automatic processor under certain environmental conditions it is desirable to avoid diluting the processing solution with an excessive amount of water. To minimize such evaporation, it is preferred to reduce the area of the antomater processor's opening to a value below 0.05 $cm^2$/ml, where this value represents the value of the area ($cm^2$) of the surface of the processing solution, i.e., the area in contact with air, divided by the amount (ml) of the processing solution in the automatic processor.

The color developer used in the present invention contains an organic preservative in place of unsubstituted hydroxylamine or the above-described sulfite ion. In the processing of color photographic papers, remarkable effects are obtained by using the organic preservative described in the present invention without using hydroxylamine, but sufficient effects can be obtained in the case of processing color photographic materials for camera use even by using the organic preservative together with hydroxylamine.

The organic preservatives of the present invention are defined as any organic compound capable of reducing the deterioration rate of an aromatic primary amine color developing agent by being added to the color developer for processing color photographic materials. That is, the organic compounds of the present invention can prevent the oxidation of the color developing agent by air, etc. Particularly useful organic preservatives for use in this invention are substituted hydroxylamines (i.e., excluding unsubstituted hydroxylamine), hydroxamic acids, hydrazines, hydrazides, phenols α-hydroxyketones, α-aminoketones, saccharides, monoamines, radicals, alcohols, oximes, diamido compounds, condensed ring amines, etc. These compounds are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-170642, JP-A-63-188742 and JP-A-63-44656, U.S. Pat. Nos. 3,615,503 and 2,494,903, JP-A-52-143020, and JP-B-48-30496.

The aforesaid preferred organic preservatives are described below in detail by reference to general formulae and by the examples which follow the formulae, but the present invention is not to be construed as being limited to the examples.

The amount of the organic preservative added to the color developer is preferably from 0.005 mol/liter to 0.5 mol/liter, and more preferably from 0.03 mol/liter to 0.1 mol/liter.

Hydroxylamines for use in this invention as the preservatives are those shown by formula (I):

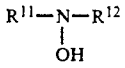

(I)

wherein $R^{11}$ and $R^{12}$ each represents a hydrogen atom, an unsubstituted or substituted alkyl group, an unsubstituted or substituted alkenyl group, an unsubstituted or substituted aryl group preferably having from 6 to 18 carbon atoms (e.g., a benzyl group, an alkylphenyl group, etc.), or a heterocyclic aromatic group; $R^{11}$ and $R^{12}$ are not simultaneously hydrogen atom; and $R^{11}$ and $R^{12}$ may combine to form a heterocyclic ring together with nitrogen atom.

The ring structure of the heterocyclic ring formed by $R^{11}$ and $R^{12}$ is a 5- or 6-membered ring composed of carbon atoms, hydrogen atoms, halogen atom(s), nitrogen atom(s), sulfur atom(s), etc., and the ring may be saturated or unsaturated.

In formula (I), $R^{11}$ and $R^{12}$ are preferably an alkyl group or an alkenyl group having preferably from 1 to 10 carbon atoms, and particularly preferably from 1 to 5 carbon atoms.

Examples of the nitrogen-containing heterocyclic ring formed by the combination of $R^{11}$ and $R^{12}$ include a piperidyl group, a pyrrolidyl group, an N-alkylpiperazyl group, a morpholyl group, an indolinyl group, a benztriazole group, etc.

Also, examples of the preferred substituent for $R^{11}$ and $R^{12}$ are a hydroxy group, an alkoxy group, an alkylsulfonyl group, an arylsulfonyl group, an amido group, a carboxy group, a cyano group, a sulfo group, a nitro group and an amino group.

Specific, non-limiting examples of hydroxylamines represented by formula (I) above are as follows:

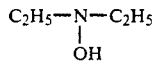

I-1

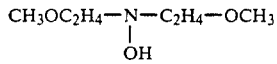

I-2

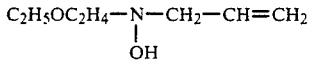

I-3

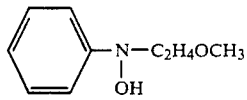

I-4

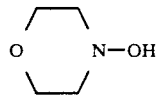

I-5

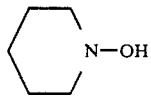

I-6

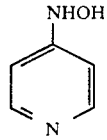

I-7

-continued

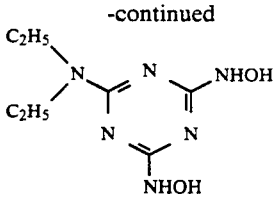

I-8

Hydroxamic acids which can be used in the present invention as the organic preservative are preferably those shown by formula (II) below:

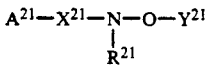

(II)

wherein $A^{21}$ represents a hydrogen atom, a substituted or unsubstituted alkyl group, a substituted or unsubstituted aryl group, a substituted or unsubstituted amino group, a substituted or unsubstituted heterocyclic group, a substituted or unsubstituted alkoxy group, a substituted or unsubstituted aryloxy group, a substituted or unsubstituted carbamoyl group, a substituted or unsubstituted sulfamoyl group, an acyl group, a carboxy group, a hydroxyamino group, or a hydroxyaminocarbonyl group and as the substituent for the aforesaid substituted groups can be a halogen atom, an aryl group, an alkyl group, an alkoxy group, etc.

$A^{21}$ is preferably a substituted or unsubstituted alkyl group, a substituted or unsubstituted aryl group, a substituted or unsubstituted amino group, a substituted or unsubstituted alkoxy group, or a substituted or unsubstituted aryloxy group, and more preferably a substituted or unsubstituted amino group, a substituted or unsubstituted alkoxy group, or a substituted or unsubstituted aryloxy group, preferably having up to 10 carbon atoms.

In formula (II), $X^{21}$ represents

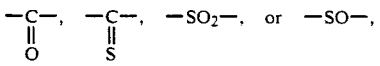

and preferably is

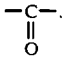

$R^{21}$ represents a hydrogen atom, a substituted or unsubstituted alkyl group, or a substituted or unsubstituted aryl group preferably having from 6 to 18 carbon atoms. $A^{21}$ and $R^{21}$ may combine with each other to form a ring structure. Examples of the substituent for $R^{21}$ include those illustrated above for $A^{21}$. $R^{21}$ is preferably a hydrogen atom.

$Y^{21}$ in formula (II) represents a hydrogen atom or a group capable of becoming a hydrogen atom by a hydrolysis reaction.

Specific, non-limiting examples of hydroxamic acids of the present invention are as follows:

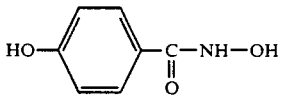

II-1

-continued

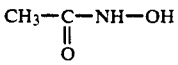

II-2

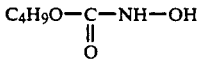

II-3

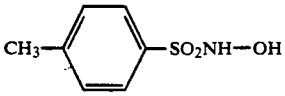

II-4

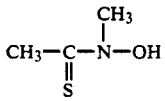

II-5

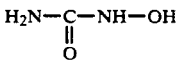

II-6

The hydrazines and hydrazides for use in the present invention as the preservatives are preferably those shown by formula (III):

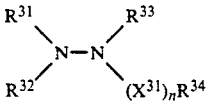

(III)

wherein $R^{31}$, $R^{32}$, and $R^{33}$ each, independently, represents a hydrogen atom, an alkyl group, an aryl group, or a heterocyclic group; $R^{34}$ represents a hydrogen atom, a hydroxy group, a hydrazino group, an alkyl group, an aryl group, a heterocyclic group, an alkoxy group, an aryloxy group, a carbamoyl group, or an amino group; $X^{31}$ represents a divalent group; and n represents 0 or 1; with the proviso that when n is 0, $R^{34}$ represents an alkyl group, an aryl group or a heterocyclic group; $R^{33}$ and $R^{34}$ may together form a heterocyclic ring.

The hydrazine analogues (hydrazines and. hydrazides) shown by formula (III), which can be used in the present invention, are explained hereinafter in detail.

In formula (III), $R^{31}$, $R^{32}$, and $R^{33}$ each, independently, represents a hydrogen atom, a substituted or unsubstituted alkyl group (preferably having from 1 to 20 carbon atoms, such as, preferably, methyl, ethyl, sulfopropyl, carboxypropyl, carboxybutyl, hydroxyethyl, cyclohexyl, benzyl, pentyl, etc.), a substituted or unsubstituted aryl group (preferably having from 6 to 20 carbon atoms, such as, preferably, phenyl group, 2,5-dimethoxyphenyl, 4-hydroxyphenyl, 2-carboxyphenyl, etc.), or a substituted or unsubstituted heterocyclic group (preferably having from 1 to 20 carbon atoms, such as, preferably, a 5- or 6- membered heterocyclic ring having at least one of oxygen, nitrogen, sulfur, etc., as the hetero atom, e.g., pyridin-4-yl and N-acetylpiperidin-4-yl).

$R^{34}$ represents a hydrogen atom, a hydroxy group, a substituted or unsubstituted hydrazino group (e.g., hydrazino, methylhydrazino, and phenylhydrazino), a substituted or unsubstituted alkyl group (preferably having from 1 to 20 carbon atoms, e.g., methyl, ethyl, sulfopropyl, carboxybutyl, hydroxyethyl, cyclohexyl, benzyl, t-butyl, and n-octyl), a substituted or unsubstituted aryl group (preferably having from 6 to 20 carbon atoms, e.g., phenyl, 2,5-dimethoxyphenyl, 4-hydroxyphenyl, 2-carboxyphenyl, and 4-sulfophenyl), a substituted or unsubstituted heterocyclic group (preferably having from 1 to 20 carbon atoms and also preferably a 5- or 6-membered heterocyclic ring having at least one of oxygen, nitrogen, and sulfur, e.g., pyridin-4-yl group and imidazolyl), a substituted or unsubstituted alkoxy group (preferably having from 1 to 20 carbon atoms, e.g., methoxy, ethoxy, methoxyethoxy, benzyloxy, cyclohexyloxy, and octyloxy), a substituted or unsubstituted aryloxy group (preferably having from 6 to 20 carbon atoms, e.g., phenoxy, p-methoxyphenoxy, p-carboxyphenoxy, and p-sulfophenoxy), a substituted or unsubstituted carbamoyl group (preferably having from 1 to 20 carbon atoms, e.g., unsubstituted carbamoyl, N,N-diethylcarbamoyl, and phenylcarbamoyl), or a substituted or unsubstituted amino group (preferably having from 0 to 20 carbon atoms, e.g., amino, hydroxyamino, methylamino, hexylamino, methoxyethylamino, carboxyethylamino, sulfoethylamino, N-phenylamino, and p-sulfophenylamino).

Examples of the substituent for $R^{31}$, $R^{32}$, $R^{33}$, and $R^{34}$ include a halogen atom (chlorine, bromine, etc.), a hydroxy group, a carboxy group, a sulfo group, an amino group, an alkoxy group, an amido group, a sulfonamido group, a carbamoyl group, a sulfamoyl group, an alkyl group, an aryl group, an aryloxy group, an alkylthio group, an arylthio group, a nitro group, a cyano group, a sulfonyl group, a sulfinyl group, etc., and these groups may be further substituted.

$X^{31}$ in formula (III) is preferably a divalent organic residue and specific examples thereof are —CO—, —SO—, and $$-\overset{\overset{\displaystyle NH}{\|}}{C}-.$$

In formula (III), n is 0 or 1 and when n is 0, $R^{34}$ is a substituted or unsubstituted alkyl group, a substituted or unsubstituted aryl group or a substituted or unsubstituted heterocyclic group. $R^{31}$ and $R^{32}$ or $R^{33}$ and $R^{34}$ may combine together to form a heterocyclic group. When n is 0, it is preferably that at least one of $R^{31}$ to $R^{34}$ is a substituted or unsubstituted alkyl group and in particular, $R^{31}$, $R^{32}$, $R^{33}$, and $R^{34}$ are preferably a hydrogen atom or a substituted or unsubstituted alkyl group. However, $R^{31}$, $R^{32}$, $R^{33}$ and $R^{34}$ cannot simultaneously be hydrogen atoms. In particular, when $R^{32}$, $R^{32}$, and $R^{33}$ are hydrogen atoms, $R^{34}$ is preferably a substituted or unsubstituted alkyl group. When $R^{31}$ and $R^{33}$ are hydrogen atoms, $R^{32}$ and $R^{34}$ are preferably substituted or unsubstituted alkyl groups. When $R^{31}$ and $R^{32}$ are hydrogen atoms, $R^{33}$ and $R^{34}$ are preferably substituted or unsubstituted alkyl groups and $R^{33}$ and $R^{34}$ may together form a heterocyclic ring.

When n is 1, $X^3$; is preferably —CO—; $R^{31}$, $R^{32}$ and $R^{33}$ are preferably hydrogen atoms, or substituted or unsubstituted alkyl groups; and $R^{34}$ is preferably a substituted or unsubstituted amino group.

In formula (III), n is most preferably 0.

The alkyl group represented by $R^{31}$, $R^{32}$, $R^{33}$, or $R^{34}$ preferably has from 1 to 10 carbon atoms, and more preferably from 1 to 7 carbon atoms. Examples of the preferred substituent for the alkyl group are a hydroxy group, a carboxylic acid group, a sulfonic acid group, and a phosphonic acid group. When two or more substituents exist, they may be the same or different.

The compound shown by formula (III) may form a bis-compound, a tris-compound or a polymer bonded at $R^{31}$, $R^{32}$, $R^{33}$, or $R^{34}$.

Specific examples of compounds shown represented by formula (III) are illustrated below, but the present invention is not to be construed as being limited thereto.

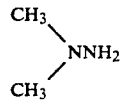
(III-1)

$CH_3NHNHCH_3$ (III-2)

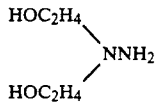
(III-3)

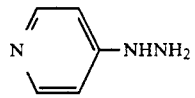
(III-4)

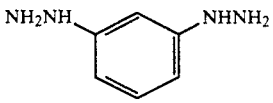
(III-5)

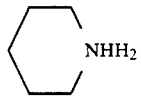
(III-6)

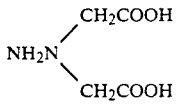
(III-7)

$HOOCCH_2NHNHCH_2COOH$ (III-8)

$NH_2NH(CH_2)_3NHNH_2$ (III-9)

$NH_2NHCH_2CH_2OH$ (III-10)

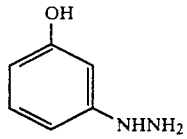
(III-11)

$NH_2NH-(CH_2)_3-SO_3H$ (III-12)

$NH_2NH-(CH_2)_4-SO_3H$ (III-13)

$NH_2NH-(CH_2)_3-COOH$ (III-14)

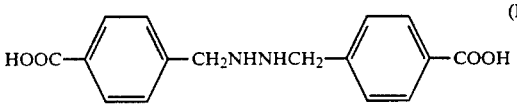
(III-15)

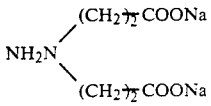
(III-16)

-continued

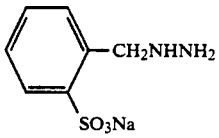
(III-17)

$NaOOCCH(CH_3)NHNHCH(CH_3)COONa$ (III-18)

$NH_2NHCH_2CH_2COONa$ (III-19)

$NH_2NHCH_2COONa$ (III-20)

$H_2NNHCH_2CH_2SO_3Na$ (III-21)

$H_2NNHCH(C_4H_9(n))COOH$ (III-22)

$H_2NNHCH(C_6H_{13}(n))COOH$ (III-23)

$H_2NN(CH(C_4H_9(n))COOH)_2$ (III-24)

$H_2NN(CH_2CH_2SO_3Na)_2$ (III-25)

$H_2NN(CH_2CH_2CH_2SO_3Na)_2$ (III-26)

$H_2NN(CH(C_2H_5(n))COOH)_2$ (III-27)

$H_2NNHCH(CH_3)COOH$ (III-28)

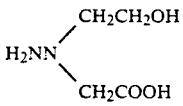
(III-29)

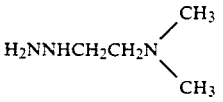
(III-30)

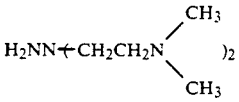
(III-31)

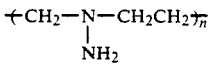
(III-32)

(average molecular weight is about 4,000)

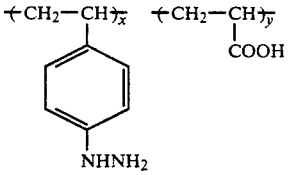
(III-33)

x:y = 60:40
(average molecular weight is about 20,000)

$NH_2NHCONH_2$ (III-34)

$NH_2NHC(=NH)NH_2$ (III-35)

$NH_2NHCONHNH_2$ (III-36)

-continued $NH_2NHSO_3H$ (III-37)

$NH_2NHSO_2NHNH_2$ (III-38)

$CH_3NHNHSO_2NHNHCH_3$ (III-39)

$NH_2NHCONH-(CH_2)_3-NHCONHNH_2$ (III-40)

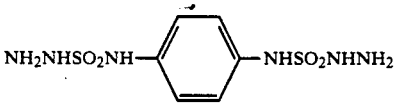
(III-41)

$NH_2NHCOCONHNH_2$ (III-42)

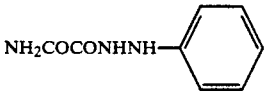
(III-43)

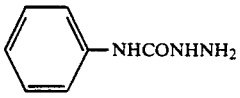
(III-44)

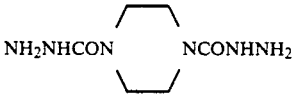
(III-45)

$NH_2NHCOCONHNH_2$ (III-46)

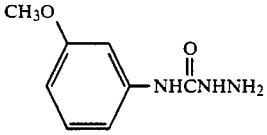
(III-47)

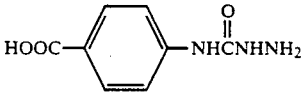
(III-48)

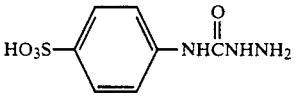
(III-49)

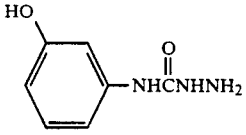
(III-50)

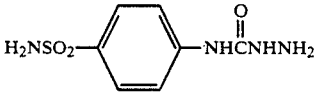
(III-51)

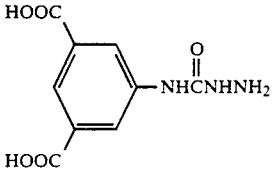
(III-52)

-continued
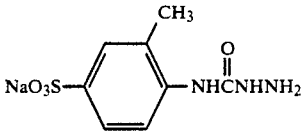
(III-53)
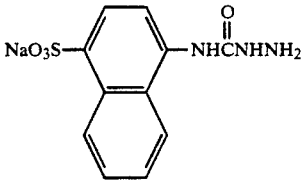
(III-54)
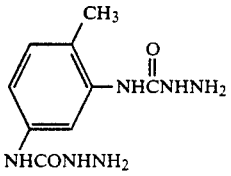
(III-55)
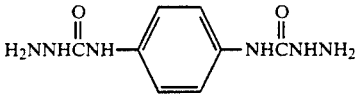
(III-56)
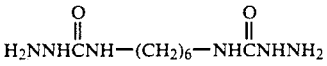
(III-57)
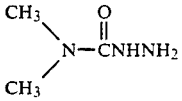
(III-58)
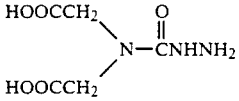
(III-59)
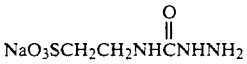
(III-60)
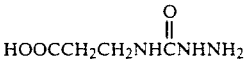
(III-61)
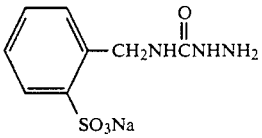
(III-62)
$NH_2NHCOOC_2H_5$ (III-63)
$NH_2NHCOCH_3$ (III-64)
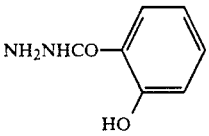
(III-65)
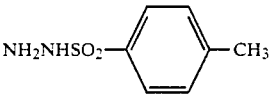
(III-66)
$NH_2NHCH_2PO_3H_2$ (III-67)
-continued
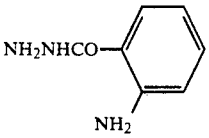
(III-68)
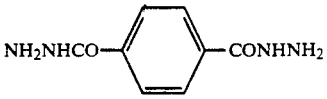
(III-69)
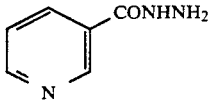
(III-70)
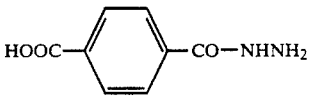
(III-71)
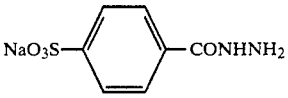
(III-72)
$(CH_3)_3CCONHNH_2$ (III-73)
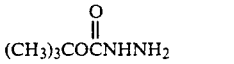
(III-74)
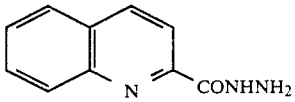
(III-75)
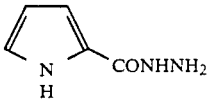
(III-76)
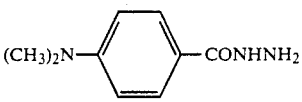
(III-77)
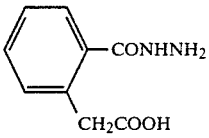
(III-78)
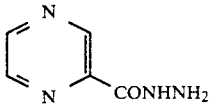
(III-79)
$HOCH_2CH_2SO_2NHNH_2$ (III-80)
$NaO_3SCH_2CH_2CONHNH_2$ (III-81)
$H_2NCONHCH_2CH_2SO_2NHNH_2$ (III-82)

-continued (III-83)

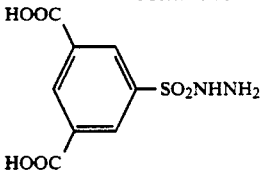

(III-84)

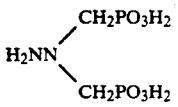

$H_2NNHCH_2CH_2PO_3H_2$ (III-85)

(III-86)

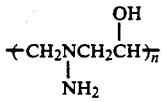

Other practical examples of the compounds of formula (III) are described in Japanese Patent Application Nos. 61-170756 (pp. 11 to 24), 61-171682 (pp. 12 to 22), and 61-173468 (pp. 9 to 19).

The compounds of formula (III) used in the present invention are mostly commercially available and also can be synthesized according to the synthesis methods described in *Organic Syntheses,* Coll. Vol. 2, pp. 208 to 213, *Journal of Organic Chemistry,* 36. 1747(1914), *Yukagaku* (*Oil Chemistry*), 24, 31 (1975), *Journal of Organic Chemistry,* 25, 44 (1960), *Yakugaku Zasshi* (*Journal of Pharmacology*), 91, 1127(1971), *Organic Syntheses,* Coll. Vol. 1, page 450, *Shin Jikken Kagaku Koza* (*New Experimetal Chemistry Cpourse*), Vol. 14, III, pp. 1621 to 1628, *Beil,* 2, 559, *Beil,* 3, page 117, E. B. Mohr et al., *Inorganic Syntheses,* 4, 32(1953), F. J. Willson and E. C. Pickering, *Journal of Chemical Society,* 123, 394(1923), N. J. Leonard and J. H. Boyer, *Journal of Organic Chemistry,* 15, 42(1950), *Organic Syntheses,* Coll. Vol. 5, page 1055, P. A. S. Smith, *Derivatives of Hydrazine and other Hydronitrogen Having n-n bonds,* pages 120 to 124 and pages 130 to 131 published by The Benjamin/Cummings Company (1983), and Staniey R, Sandier Waif Karo, *Organic Functional Group Preparation,* Vol. 1, 2nd Edition, page 457.

Phenols for use in the present invention as the organic preservatives are preferably those shown by following formula (IV):

(IV)

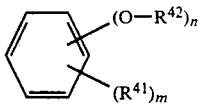

wherein $R^{41}$ represents a hydrogen atom, a halogen atom, an alkyl group, an aryl group, an alkoxy group, an aryloxy group, a carboxy group, a sulfo group, a carbamoyl group, a sulfamoyl group, an amido group, a sulfonamido group, a ureido group, an alkylthio group, an arylthio group, a nitro group, a cyano group, an amino group, a formyl group, an acyl group, a sulfonyl group, a alkoxycarbonyl group, an aryloxycarbonyl group, an alkoxysulfonyl group or an aryloxysulfonyl group. When $R^{41}$ is substituted, the substituent can be a halogen atom, an alkyl group, an aryl group, a hydroxy group, an alkoxy group, etc. Also, when two or more $R^{41}$s exist, they may be the same or different or when they are adjacent, they may combine with each other to form a ring. The ring structure is a 5- or 6-membered ring composed of carbon atoms, hydrogen atoms, halogen atom(s), nitrogen atom(s), oxygen atom(s), sulfur atom(s), etc., and they may be saturated or unsaturated.

$R^{42}$ in the above formula represents a hydrogen atom or a group capable of being hydrolyzed; m and n each represents an integer of from 1 to 5.

In formula (IV), $R^{41}$ is preferably an alkyl group, a halogen atom, an alkoxy group, an alkylthio group, a carboxy group, a sulfo group, a carbamoyl group, a sulfamoyl group, an amino group, an amido group, a sulfonamido group, a nitro group, or a cyano group. Among them, an alkoxy group, an alkylthio group, an amino group, and a nitro group are particularly preferred. $R^{41}$ more preferably exists at the para-position or ortho-position with respect to O-$R^{42}$. Also, $R^{41}$ preferably has from 1 to 10, and more preferably from 1 to 6, carbon atoms.

$R^{42}$ is preferably a hydrogen atom or a group having from 1 to 5 carbon atoms, said group capable of being hydrolyzed. Also, when two or more (O-$R^{42}$)s exist, they more preferably exist at the ortho-position or para-position with respect to each other.

Specific examples of compounds represented by formula (IV) are illustrated below, but the present invention is not to be construed as being limited thereto.

IV-1

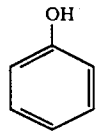

IV-2

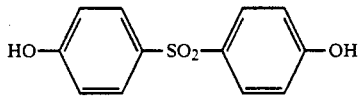

IV-3

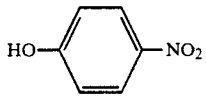

IV-4

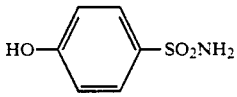

IV-5

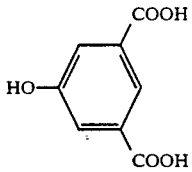

IV-6

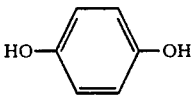

IV-7

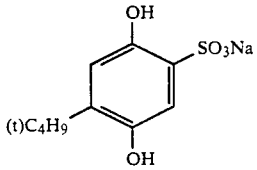

-continued

IV-8

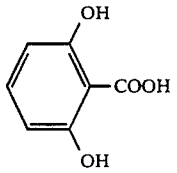

IV-9

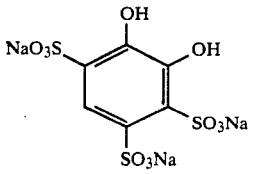

IV-10

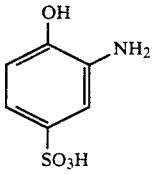

IV-11

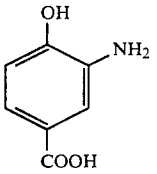

The α-hydroxyketones and the α-aminoketones used in the present invention as the preservatives are preferably those shown by formula (V):

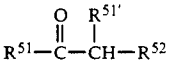

(V)

wherein $R^{51}$ represents a hydrogen atom, a substituted or unsubstituted alkyl group, a substituted or unsubstituted aryl group, a substituted or unsubstituted alkoxy group, a substituted or unsubstituted aryloxy group, or a substituted or unsubstituted amino group and $R^{52}$ represents a hydrogen atom, a substituted or unsubstituted alkyl group, or a substituted or unsubstituted aryl group; $R^{51}$ and $R^{52}$ may form together a carbon ring or a heterocyclic ring, and $R^{51'}$ represents a hydroxy group or a substituted or unsubstituted amino group.

In formula (V), $R^{51}$ preferably represents a hydrogen atom, an alkyl group, an aryl group, or an alkoxy group, and $R^{52}$ preferably represents a hydrogen atom or an alkyl group.

Specific examples of compounds represented by formula (V) are illustrated below, but the present invention is not to be construed as being limited thereto.

V-1

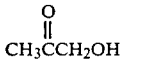

V-2

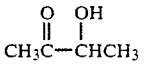

V-3

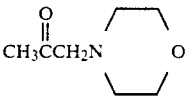

-continued

V-4

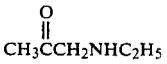

V-5

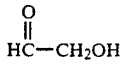

V-6

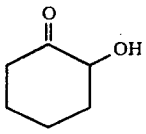

V-7

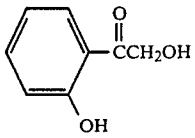

V-8

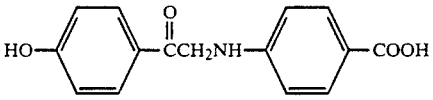

V-9

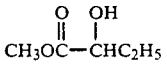

V-10

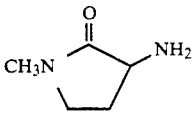

Saccharides can also be used as the organic preservatives in the present invention. Saccharides (also called as carbohydrate) includes monosaccharides and polysaccharides and many of them are represented by the formula $C_nH_{2m}O_m$.

Monosaccharides generally include the aldehydes or ketones of polyhydric alcohol (called aldose and ketose, respectively); the reduction derivatives, oxidation derivatives, and dehydration derivatives thereof; amino sugar; thio sugar, etc. A polysaccharide is a product formed by the dehydration condensation of two or more monosaccharides.

Of the saccharides of the present invention, aldose having a reducing aldehyde group and the derivatives thereof are preferred. Most preferred are monosaccharides of aldose having a reducing aldehyde group and the derivatives thereof.

Practical, non-limiting examples of the saccharides of the present invention are illustrated below:

VI-1: D-xylose
VI-2: L-Arabinose
VI-3: D-Ribose
VI-4: D-Deoxyribose
VI-5: D-Glucose
VI-6: D-Galactose
VI-7: D-Manose
VI-8: Glucosamine
VI-9: L-Sorbose
VI-10: D-Sorbit (Sorbitol)

The monoamines used in the present invention as the organic preservative are represented by formula (VII) below:

$$R^{71}-\overset{\overset{R^{72}}{|}}{N}-R^{73} \quad \text{(VII)}$$

wherein $R^{71}$, $R^{72}$, and $R^{73}$ each represents a hydrogen atom, an alkyl, alkenyl, aryl or aralkyl group preferably having up to 18 carbon atoms, or a heterocyclic group preferably being a 5- or 6-membered ring (e.g., oxazol ring, azol ring, etc.); said $R^{71}$ and $R^{72}$, said $R^{71}$ and $R^{73}$ or said $R^{72}$ and $R^{73}$ may combine with each other to form a nitrogen-containing heterocyclic ring.

In this case, $R^{71}$, $R^{72}$, and $R^{73}$ may have a substituent. $R^{71}$, $R^{72}$, and $R^{73}$ are more preferably a hydrogen atom or an alkyl group. The substituent for these groups may be a hydroxy group, a sulfon group, a carboxy group, a halogen atom, a nitro group, an amino group, etc.

Specific, non-limiting examples of compounds represented by formula (VII) are illustrated below:

$N(CH_2CH_2OH)_3$ VII-1

$H_2NCH_2CH_2OH$ VII-2

$HN(CH_2CH_2OH)_2$ VII-3

$C_7H_{15}N(CH_2\overset{\overset{OH}{|}}{C}HCH_2OH)_2$ VII-4

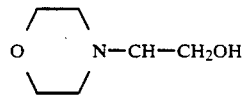
VII-5

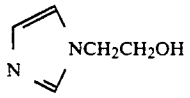
VII-6

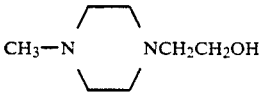
VII-7

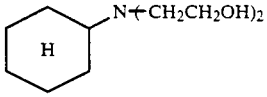
VII-8

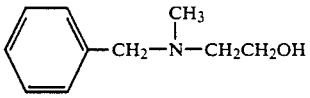
VII-9

$(HOCH_2CH_2)_2NCH_2CH_2SO_2CH_3$ VII-10

$HN(CH_2COOH)_2$ VII-11

$HOOCCH_2CH_2\underset{\underset{NH_2}{|}}{C}HCOOH$ VII-12

$H_2NCH_2CH_2SO_2HN_2$ VII-13

$(C_2H_5)_2N-CH_2CH_2OCH_2CH_2OH$ VII-14

$H_2N-C(CH_2OH)_2$ VII-15

-continued $HOCH_2\underset{\underset{NH_2}{|}}{C}HCOOH$ VII-16

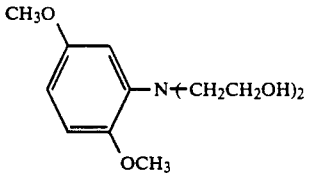
VII-17

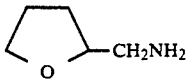
VII-18

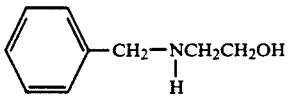
VII-19

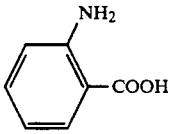
VII-20

The preferred diamines used in the present invention as the organic preservative are illustrated by formula (VIII) below:

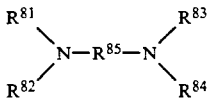
(VIII)

wherein $R^{81}$, $R^{82}$, $R^{83}$, and $R^{84}$ each represents a hydrogen atom, an alkyl group, an alkenyl group, an aryl group, an aralkyl group, or a heterocyclic group and $R^{85}$ represents a divalent organic group such as, an alkylene group, an arylene group, an aralkylene group, an alkenylene group, or a heterocyclic group.

$R^{81}$, $R^{82}$, $R^{83}$, and $R^{84}$ are preferably a hydrogen atom, and $R^{85}$ is preferably an alkylene group.

Specific, non-limiting examples of compounds represented by formula (VIII) are illustrated below:

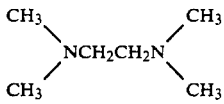
VIII-1

$(HOCH_2CH_2)_2NCH_2CH_2N(CH_2CH_2OH)_2$ VIII-2

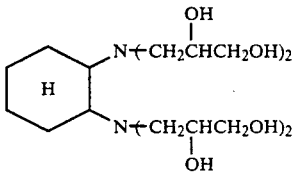
VIII-3

$H_2NCH_2CH_2N(CH_2CH_2OH)_2$ VIII-4

$H_2NCH_2\underset{\underset{OH}{|}}{C}HCH_2NH_2$ VIII-5

-continued

VIII-6

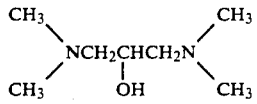

VIII-7

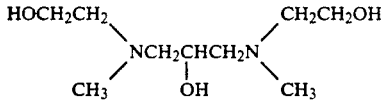

VIII-8

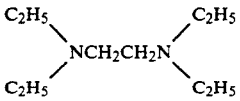

VIII-9

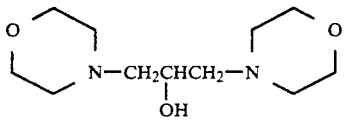

VIII-10

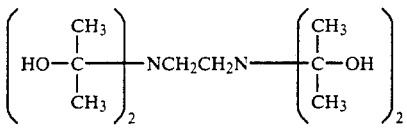

VIII-11

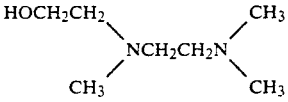

The polyamines used in the present invention as the organic preservative are preferably those represented by formula (IX):

(IX)

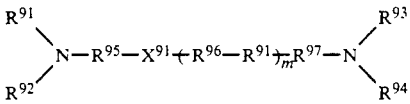

wherein $R^{91}$, $R^{92}$, $R^{93}$, and $R^{94}$ each represents a hydrogen atom, an alkyl group, an alkenyl group, an aryl group, an aralkyl group, or a heterocyclic group; $R^{95}$, $R^{96}$, and $R^{97}$ each represents a divalent organic group and is the same as defined above for $R^{85}$ of formula (VIII): $X^{91}$ and $X^{92}$ each represents

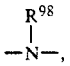

—O—, —S—, —CO—, —$SO_2$—, —SO—, or a linkage group composed of the combination of these aforesaid linkage groups (wherein $R^{98}$ has the same significance as $R^{91}$, $R^{92}$, $R^{93}$, and $R^{94}$); and m represents an integer of 0 or more, so long as the upper limit of m is such that the aforesaid compound may have a molecular weight not so high as to make the compound insoluble in water. Preferably, m is from 1 to 3.

Specific, non-limiting examples of compounds represented by formula (IX) are illustrated below:

IX-1

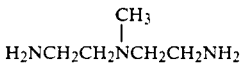

IX-2

-continued

IX-3

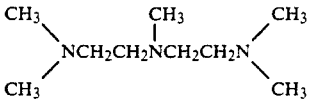

IX-4

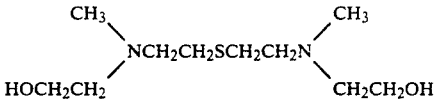

IX-5

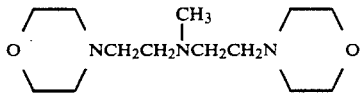

IX-6

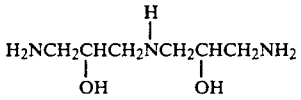

IX-7

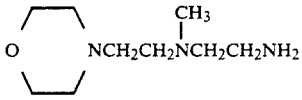

The quaternary ammonium salt for use in this invention as the preservatives are preferably those shown by formula (IX) below:

(X)

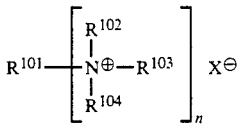

wherein $R^{101}$ represents an n-valent organic group and $R^{102}$, $R^{103}$, and $R^{104}$ each represents a mono-valent organic group. In addition, the organic group is a group having at least one carbon atom and is, practically, an alkyl group, an aryl group, a heterocyclic group, etc. At least two of said $R^{102}$, $R^{103}$, and $R^{104}$ may combine with each other to form a heterocyclic ring containing the quaternary ammonium aron. In the above formula, n is an integer of 1 or more and $X^{\ominus}$ represents an anion.

The particularly preferred monovalent group shown by $R^{102}$, $R^{103}$, and $R^{104}$ is a substituted or unsubstituted alkyl group and it is most preferred that at least one of $R^{102}$, $R^{103}$, and $R^{104}$ is a hydroxyalkyl group, an alkoxyalkyl group or a carboxyalkyl group. Also, n is preferably an integer of from 1 to 3, and more preferably 1 or 2.

Specific, non-limiting examples of compounds represented by formula (X) are illustrated below.

X-1

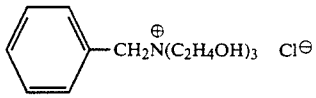

X-2

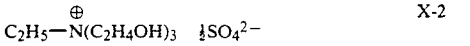

X-3

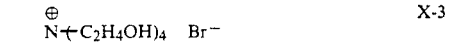

X-4

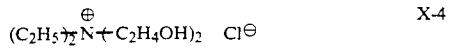

-continued

X-5

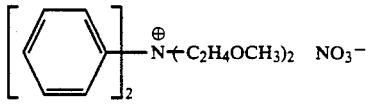

X-6

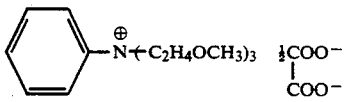

X-7

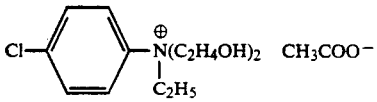

X-8

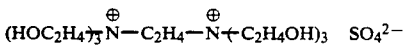

X-9

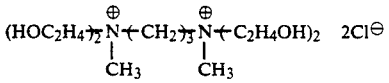

X-10

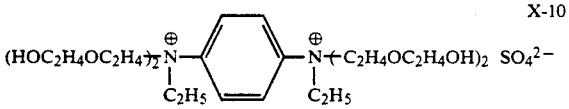

The nitroxy radicals used in the present invention as the organic preservative are preferably those shown by formula (XI) below:

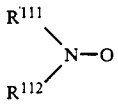

(XI)

wherein $R^{111}$ and $R^{112}$ each represents a hydrogen atom, an alkyl group, an aryl group, or a heterocyclic group. The alkyl group, aryl group and heterocyclic group may have a substituent such as a hydroxy group, an oxo group, a carbamoyl group, an alkoxy group, a sulfamoyl group, a carboxy group, and a sulfo group.

Examples of the heterocyclic group include a pyridyl group, a piperidyl group, etc.

$R^{111}$ and $R^{112}$ are preferably a substituted or unsubstituted aryl group or a substituted or unsubstituted tertiary alkyl group (e.g., t-butyl group).

Specific, non-limiting examples of compounds represented by formula (XI) are illustrated below:

XI-1

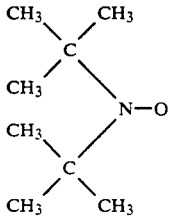

-continued

XI-2

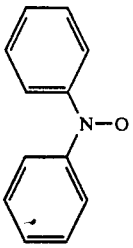

XI-3

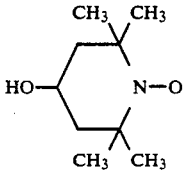

XI-4

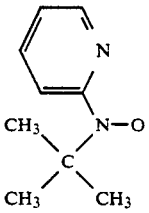

XI-5

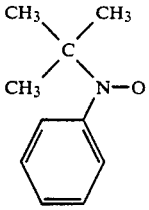

The alcohols used in the present invention as the organic preservative are preferably those represented by formula (XII):

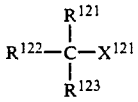

(XII)

wherein $R^{121}$ represents hydroxy-substituted alkyl group; $R^{122}$ represents an unsubstituted alkyl group or a hydroxy-substituted alkyl group; $R^{123}$ represents a hydrogen atom, an unsubstituted alkyl group or a hydroxy-substituted alkyl group; and $X^{121}$ represents a hydroxy-group, a carboxy group, a sulfo group, a nitro group, an unsubstituted or hydroxy-substituted alkyl group, an unsubstituted or substituted amido group, or a sulfonamido group.

In formula (XII), $X^{121}$ is preferably a hydroxy group, a carboxy group, or a hydroxyalkyl group.

Specific, non-limiting examples of compounds represented by formula (XII) are illustrated below:

XII-1

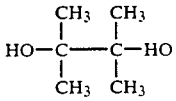

-continued

XII-2

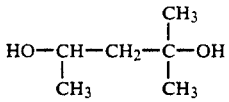

XII-3

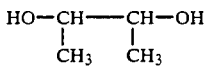

XII-4 $HO-CH(CH_2OH)_2$

XII-5 $(HO-CH_2)_3COOH$

XII-6 $C(CH_2OH)_4$

XII-7 $(HOCH_2)_3C-CH_3$

XII-8 $(HOCH_2)_3C-NHCOCH_3$

XII-9

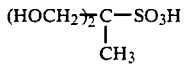

XII-10

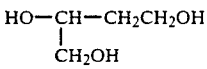

The alcohols used in the present invention as the organic preservative are preferably those represented by formula (XIII):

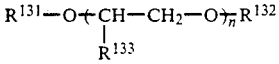

(XIII)

wherein $R^{131}$, $R^{132}$, and $R^{133}$ each represents a hydrogen atom or an alkyl group and n represents a positive integer up to 500.

The alkyl group shown by $R^{131}$, $R^{132}$, and $R^{133}$ has preferably 5 or less carbon atoms, and more preferably 1 or 2 carbon atoms. $R^{131}$, $R^{132}$, and $R^{133}$ are preferably a hydrogen atom or a methyl group, and most preferably a hydrogen atom.

Also, n is a positive integer of, preferably, from 3 to 100, and more preferably from 3 to 30.

Specific, non-limiting examples of compounds represented by formula (XIII) are illustrate below:

XIII-1 $HO(CH_2CH_2O)_4OH$

XIII-2 $CH_3O(CH_2CH_2O)_3OH$

XIII-3 $CH_3O(CH_2CH_2O)_3OCH_3$

XIII-4

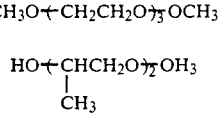

XIII-5 $HOCH_2CH_2OCH_3$

XIII-6 $C_2H_5O(CH_2CH_2O)_2OH$

XIII-7 $HO(CH_2CH_2O)_nH$
average molecular weight about 300

XIII-8 $HO(CH_2CH_2O)_nH$
average molecular weight about 800

XIII-9 $HO(CH_2CH_2O)_nH$
average molecular weight about 3,000

-continued

XIII-10 $HO(CH_2CH_2O)_nH$
average molecular weight about 8,000

The oximes used in the present invention as the organic preservative are preferably those represented by formula (XIV):

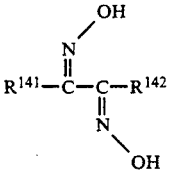

(XIV)

wherein $R^{141}$ and $R^{142}$ each represents a hydrogen atom, a substituted or unsubstituted alkyl group, or a substituted or unsubstituted aryl group, also $R^{141}$ and $R^{142}$ may be the same or different and may be combined with each other.

In formula (XIV), $R^{141}$ and $R^{142}$ are preferably an unsubstituted alkyl group or an alkyl group substituted by a halogen atom, a hydroxy group, an alkoxy group, an amino group, a carboxy group, a sulfo group, a phosphonic acid group, or a nitro group.

Also, the sum of the carbon atoms in formula (XIV) is preferably 30 or less, and more preferably 20 or less.

Specific, non-limiting examples of compounds represented by formula (XIV) are illustrated below:

XIV-1

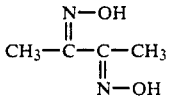

XIV-2

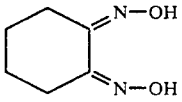

XIV-3

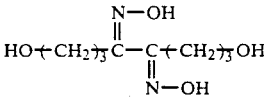

XIV-4

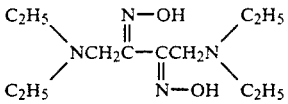

XIV-5

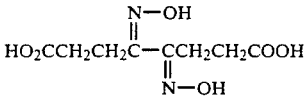

The polyamines used in the present invention as the preservative are preferably those shown by formula (XV):

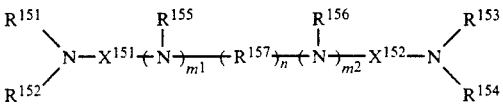

(XV)

wherein $X^{151}$ and $X^{152}$ each represents —CO— or —$SO_2$—; $R^{151}$, $R^{152}$, $R^{153}$, $R^{155}$, and $R^{156}$ each represents a hydrogen atom or a substituted or unsubstituted alkyl group; $R^{157}$ represents a substituted or unsubstituted alkylene group, a substituted or unsubstituted arylene group, or a substituted or unsubstituted aralkylene group; and $m^1$, $m^2$ and n each represents 0 or 1.

Specific, non-limiting examples of compounds represented by formula (XV) are illustrated below:

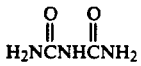

XV-1

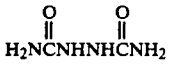

XV-2

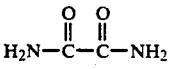

XV-3

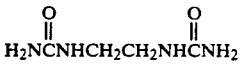

XV-4

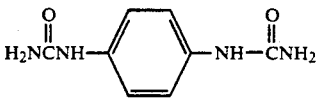

XV-5

$H_2NSO_2NHSO_2NH_2$

XV-6

The condensed ring type amines used in the present invention as the organic preservative are preferably those represented by formula (XVI):

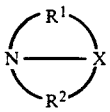

(XVI)

wherein X represents a tri-valent atomic group necessary for completing a condensed ring and $R^1$ and $R^2$, which may be the same or different, each represents an alkylene, arylene, alkenylene or aralkylene group preferably having from 2 to 8 carbon atoms.

The particularly preferred compounds represented by formula (XVI) are those represented by formula (1-a) and (1-b):

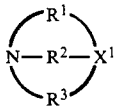

(1-a)

wherein $X^1$ represents

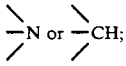

$R^1$ and $R^2$ have the same definition as defined in formula (XVI), and $R^3$ is the same as defined above for $R^1$, or $R^3$ can be

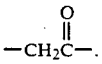

In formula (1-a), $X^1$ is preferably

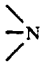

and $R^1$, $R^2$, or $R^3$ each has preferably 6 or fewer carbon atoms, more preferably 3 or fewer, and most preferably 2.

Also, $R^1$, $R^2$, and $R^3$ are preferably an alkylene group or an arylene group, and most preferably an alkylene group;

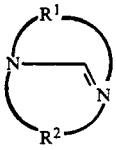

(1-b)

wherein $R^1$ and $R^2$ have the same definition as in formula (XVI).

In formula (1-b), $R^1$ and $R^2$ each has preferably 6 or fewer carbon atoms, and $R^1$ and $R^2$ are preferably an alkylene group or an arylene group and more preferably an alkylene group.

In the compounds, represented by formulae (1-a) and (1-b), the compounds represented by formula (1-a) and preferred.

Specific, non-limiting examples of compounds represented by formula (XVI) are illustrated below:

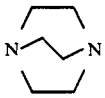

XVI-1

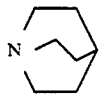

XVI-2

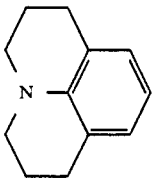

XVI-3

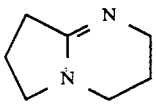

XVI-4

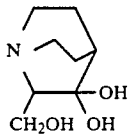

XVI-5

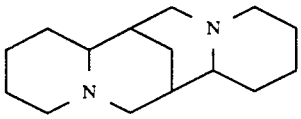

XVI-6

-continued

XVI-7

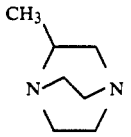

XVI-8

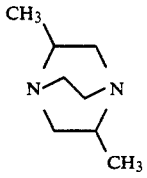

XVI-9

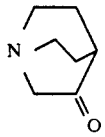

XVI-10

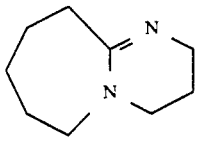

XVI-11

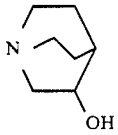

XVI-12

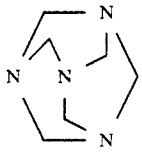

XVI-13

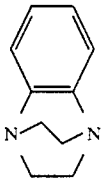

XVI-14

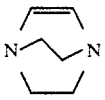

XVI-15

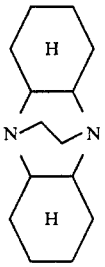

XVI-16

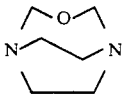

-continued

XVI-17

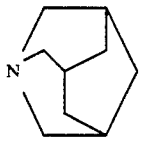

XVI-18

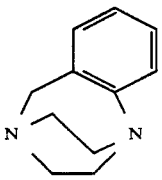

The compounds of formula (XV) used in this invention are mainly commercially available. Also, these compounds can be synthesized according to the methods described in the following documents: Khim Geterotsikl Soedin, (2), 272–275(1976); U.S. Pat. Nos. 3,297,701; 3,375,252; Khim Geterotsikl Soedin, (8), 1123–1126(1976); U.S. Pat. No. 4,092,316; The organic preservatives described above in formulae (I) to (XVI) may be used singly or in combination. A preferred combination of these compounds comprises at least one compound represented by formulae (I), (II), (III), (IV), (V), or (VI) and at least one compound represented by formulae (VII), (VIII), (IX), (X), (XI), (XII), (XIII), (XIV), (XV), or (XVI) at the molar ratio of 1:100 to 100:1 and preferably 1:10 to 10:1. A further preferred combination is a compound represented by formulae (I) or (III) and at least one compound of those shown by formulae (VII) or (XVI). The most preferred combination comprises at least one compound represented by formula (I) and at least one compound represented by formula (VII).

Each step of the processing method of this invention is explained below.

Color Development

The color developer used in the present invention contains an aromatic primary amine color developing agent such as, preferably a p-phenylenediamine derivative. Typical color developing agents are listed below, but the invention is not to be construed as being limited thereto:

D-1: N,N-Diethyl-p-phenylenediamine

D-2: 2-Amino-5-diethylaminotoluene

D-3: 2-Amino-5-(N-ethyl-N-laurylamino)toluene

D-4: 4-[N-Ethyl-N-(8-hydroxyethyl)aminoaniline

D-5: 2-Methyl-4-[N-ethyl-N-(8-hydroxyethyl-)amino]-aniline

D-6: 4-Amino-3-methyl-N-ethyl-N-[8-(methanesulfonamido)ethyl]aniline

D-7: N-(2-Amino-5-diethylaminophenylethyl)methanesulfonamide

D-8: N,N-Dimethyl-p-phenylenediamine

D-9: 4-Amino-3-methyl-N-ethyl-N-methoxyethylaniline

D-10: 4-Amino-3-methyl-N-ethyl-N-8-ethoxyethylaniline

D-11: 4-Amino-3-methyl-N-ethyl-N-8-butoxyethylaniline.

Also, the aforesaid phenylenediamine derivatives may be used in the form of sulfates, hydrochlorides, sulfites, or p-toluenesulfonates.

The amount of the aromatic primary amine developing agent is preferably from about 0.1 g to about 20 g, and more preferably from about 0.5 g to about 10 g, per liter of the developer.

Also, the color developer can contain, if necessary, a sulfite such as sodium sulfite, potassium sulfite, sodium hydrogensulfite, potassium hydrogensulfite, sodium metasulfite, potassium metasulfite, etc., or a carbonyl sulfurous acid addition product as a preservative in addition to the organic preservative used in the present invention. However, for improving the coloring property of the color developer, the amount of the sulfite ion added to the organic preservative is preferably kept to a minimum.

That is, the amount of the sulfite ion added is from 0 to 0.01 mol, preferably from 0 to 0.005 mol, and most preferably from 0 to 0.002 mol, per liter of the color developer. The addition amount of the sulfite ion is preferably kept low in order to minimize the change in photographic characteristics when processing is performed using a lower amount of processing solution.

Also, the addition amount of hydroxylamine which is conventionally used as a preservative for a color developer is preferably less. by the same reason as described above. Practically, the addition amount of hydroxylamine is from 0 to 0.02 mole, more preferably from 0 to 0.01 mol, and most preferably from 0 to 0.005 mol, per liter of the color developer.

The pH of the color developer used in the present invention is preferably from 9 to 12, and more preferably from 9 to 11.0, and in addition, the color developer can contain compounds known as developer components.

For maintaining the aforesaid pH of the color developer, it is preferred to use various kinds of buffers in this invention. Examples of an effective buffer include carbonates, phosphates, borates, tetraborates, hydroxybenzoates, glycyl salts, N,N-dimethylglysine salts, leucine salts, norleucine salts, guanine salts, 3,4-dihydroxyphenylalanine salts, alanine salts, aminobutyrates, 2-amino-2-methyl-1,3-propanedilol salts, valine salts, proline salts, trishydroxyaminomethane salts, lysine salts, etc. In particular, carbonates, phosphates, tetraborates, and hydroxybenzoates are preferably used as the buffer since they have excellent solubility and at a high pH range, i.e., higher than 9.0, they function well as a buffer yet have no adverse effects (e.g., fog, etc.) on the photographic performance when they are added to the color developer, and they are inexpensive.

Practical examples of these buffers are sodium carbonate, potassium carbonate, sodium hydrogencarbonate, potassium hydrogencarbonate, tri-sodium phosphate, tri-potassium phosphate, di-sodium phosphate, di-potassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited to these compounds.

The addition amount of the aforesaid buffer to the color developer is preferably higher than 0.1 mol/liter, and more preferably from 0.1 mol/liter to 0.4 mol/liter.

Furthermore, the color developer may contain various chelating agents as an agent for preventing the precipitation of calcium or magnesium or for improving the stability of the color developer.

Preferred examples of chelating agents include organic compounds such as aminopolycarboxylic acids described in JP-B-48-30496 and JP-B-44-30232, organic phosphonic acids described in JP-A-56-97347, JP-B-56-39359, and West German Patent 2,227,639, phosphonocarboxylic acids described in JP-A-52-102726, JP-A-53-42730, JP-A-54-121127, JP-A-55-126241, and JP-A-55-659506, and other compounds described in JP-A-58-195845 and JP-A-58-203440 and JP-B-53-40900. Specific, non-limiting examples of chelating agents which are usable in the present invention include are nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, glycol ether diaminetetraacetic acid, ethylenediamine o-hydroxyphenylacetic acid, 2-phosphonobutane-1,2,4-tricarboxylic acid, 1-hydroxyethylidene-1,1-diphosphonic acid, N,N'-bis(2-hydroxybenzyl-)ethylenediamine-N,N'-diacetic acid, etc.

These chelating agents may be used singly or in combination.

The amount of the chelating agent added is an amount sufficient for blocking metal ions in the color developer and is, for example, from about 0.1 g to 10 g per liter of the developer.

Furthermore, the color developer may optionally contain an optional development accelerator. However, from the standpoint of preventing environmental pollution, easiness of the preparation of the developer, and preventing color staining, the color developer for use in this invention preferably contains substantially no benzyl alcohol. The term "contains substantially no benzyl alcohol" means that the developer contains less than 2 ml of benzyl alcohol per liter of the developer, and preferably no benzyl alcohol.

The aforesaid organic preservatives for use in this invention produce remarkable results when used in a processing method in which the color developer contains substantially no benzyl alcohol.

Other development accelerators for use in the present invention are thioether series compounds described in JP-B-37-16088, JP-B-37-5987, JP-B-38-7826, JP-B-44-12380, and JP-B-45-9019, and U.S. Pat. No. 3,813,247, p-phenylenediamine series compounds described in JP-A-52-49829 and JP-A-50-15554, quaternary ammonium salts described in JP-A-50-137726, JP-B-44-30074, JP-A-56-156826 and JP-A-52-43429, amine series compounds described in U.S. Pat. Nos. 2,494,903, 3,128,182, 4,230,796, 3,253,919, 2,482,546, 2,596,926, and 3,582,326, and JP-B-41-11431, polyalkylene oxide, 1-phenyl-3-pyrazolidones, and imidazoles described in U.S. Pat. Nos. 3,128,183 and 3,532,501, JP-B-37-16088, JP-B-42-25201, JP-B-41-11431, and JP-B-42-23883.

Moreover, the color developer used in the present invention may contain an optional antifoggant. Examples of this antifoggant include alkali metal halides such as sodium chloride, potassium bromide, potassium iodide, etc., and organic antifoggants such as nitrogen-containing heterocyclic compounds, e.g., benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethyl-benzimidazole, indazole, hydroxyazaindrizine, and adenine.

It is preferred that the color developer used in the present invention contains an optional whitening agent. As the optical whitening agent, 4,4'-diamino-2,2'-disulfostilbene series compounds are preferred. The amount of the optional whitening agent added to the color developer is preferably from 0 to 5 g/liter, more preferably from 0.1 to 4 g/liter.

Furthermore, the color developer may optionally contain various kinds of surface active agents such as alkylsulfonic acids, arylphosphonic acids, aliphatic carboxylic acids, aromatic carboxylic acids, etc.

The processing temperature of the color developer in this invention is from 20° C. to 50° C., and preferably from 30° C. to 40° C. The processing time is from 20 seconds to 2 minutes, and preferably from 30 seconds to 1 minute.

The amount of the replenisher for the color developer is preferably kept at a minimum but is generally from 20 ml to 600 ml, preferably from 30 ml to 300 ml, and more preferably from 30 ml to 120 ml per $m^2$ of the photographic material to be processed.

Blix Solution

As a bleaching agent which is used for a blix solution in the present invention, any bleaching agents can be used but in particular, complex organic salts (e.g., complex organic salts of aminopolycarboxylic acids such as ethylenediaminetetraacetic acid, diethylenetriaminepentaacetic acid, etc., aminopolyphosphonic acid, phosphonocarboxylic acid, and organic phosphonic acids) of iron(III), organic acids such as citric acid, tartaric acid, malic acid, etc., persulfates, and hydrogen peroxide are preferred.

In these materials, organic complex salts of iron(III) are particularly preferred from the view point of quick processing and the prevention of environmental pollution. Specific examples of the aminopolycarboxylic acid useful for forming the organic complex salts of iron(III) are ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, glycol ether diaminetetraacetic acid, etc.

These compounds may be in the form of sodium salts, potassium salts, lithium salts or ammonium salts. In these compounds, the iron(III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferred owing to the high bleaching power.

The ferric ion complex salts may be used in the form of complex salt or may be formed in a solution using a ferric salt (e.g., ferric sulfate, ferric chloride, ferric nitrate, ferric ammonium sulfate, and ferric phosphate) and a chelating agent (e.g., aminopolycarboxylic acids, aminopolyphosphoric acids, phosphonocarboxylic acid, etc.). Also, a chelating agent may be used in an excessive amount over the amount of forming the ferric complex salt. In the iron complex salts, aminopolycarboxylic acid iron complex salt is preferred and the addition amount thereof is from 0.01 mol/liter to 1.0 mol/liter, and preferably from 0.05 mol/liter to 0.50 mol/liter.

For the bleach solution, blix solution and/or the prebath thereof, various compounds can be used as a bleach accelerator. As examples of the bleach accelerator, compounds having a mercapto group or a disulfide bond described in U.S. Pat. No. 3,893,858, German Patent 1,290,812, JP-A-53-95630, and *Research Disclosure*, No. 17129 (July, 1978), thiourea series compounds described in JP-B-45-8506, JP-A-52-20832 and JP-A-53-32735, and U.S. Pat. No. 3,706,561 and halide ions such as iodide ions, bromide ions, etc., are preferred in the point of excellent bleaching power.

Furthermore, the blix solution for use in this invention can further contain a rehalogenating agent such as a bromide (e.g., potassium bromide, sodium bromide, and ammonium bromide), a chloride (e.g., potassium chloride, sodium chloride, and ammonium chloride), and an iodide (e.g., ammonium iodide). Also, if necessary, the blix solution may further contain a corrosion inhibitor such as at least one kind of inorganic acid or organic acid having a pH buffer function, or an alkali metal salt or an ammonium salt thereof, such as boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc., ammonium nitrate, guanidine, etc.

Examples of a fixing agent which is may be used for the blix solution in the present invention include thiosulfates such as sodium thiosulfate, ammonium thiosulfate, etc.; thiocyanates such as sodium thiocyanate, ammonium thiocyanate, etc., thioether compounds such as ethylene-bisthioglycollic acid, 3,6-dithia-1,8-octanedion, etc., and water-soluble silver halide solvents such as thioureas. They may be used singly or as a mixture thereof.

Also, a specific blix solution composed of a combination of a fixing agent and a large amount of a halide such as potassium iodide described in JP-A-55-155354 can be used in this invention. In this invention, it is preferred to use a thiosulfate, in particular ammonium thiosulfate as a fixing agent. The amount of the fixing agent is preferably from 0.3 mol to 3 mols, and more preferably from 0.5 mol to 2.0 mols per liter of the blix solution. The pH range of the blix solution or the fix solution used in this invention is preferably from 3 to 10, and more preferably from 5 to 9.

Also, the blix solution used in this invention can further contain various kinds of optical whitening agents, defoaming agents, surface active agents, and organic solvents (e.g., polyvinylpyrrolidone and methanol).

The blix solution used in this invention contains a compound releasing sulfite ions, such as a sulfate (e.g., sodium sulfite, and potassium sulfite, ammonium sulfite), a hydrogensulfite (e.g., ammonium hydrogensulfite, sodium hydrogensulfite, and potassium hydrogensulfite), a metahydrogensulfite (e.g., potassium metahydrogensulfite, sodium metahydrogensulfite, and ammonium metahydrogensulfite), or a sulfinic acid as a preservative. The content of the aforesaid sulfite-releasing compound is preferably such that from about 0.02 to 0.50 mol of the sulfite ion, more preferably from 0.04 to 0.40 mol of the sulfite ion, is released per liter of the blix solution.

As the preservative which is used for the blix solution in this invention, sulfites are generally used, but ascorbic acid, a carbonyl-hydrogensulfuric acid addition product, or a carbonyl compound may be added thereto. The blix solution used in this invention may optionally contain a buffer, a chelating agent, an antifungal agent, etc.

In the blix solution used in this invention, a part or the whole of the overflow of wash water and/or stabilization solution, which is a post-bath of the blix solution is introduced into the blix solution. The amount thereof is from 10 ml to 500 ml, preferably from 20 ml to 300 ml, and most preferably from 30 ml to 200 ml per square meter of the light-sensitive material being processed.

If the amount of water replenisher solution and/or the stabilizer solution introduced into the blix solution is small, processing costs go down and there is less need to reduce the amount of waste liquid. However, if the amount is too large, the blix solution becomes diluted and inferior desilvering occurs.

It is preferred that the concentration of the blix solution is as high as possible for the purpose of reducing the amount of the waste liquid. The optimum concentration of the bleaching agent is from 0.15 mol/liter to 0.40 mol/liter and the optimum concentration of the fixing agent is from 0.5 mol/liter to 2.0 mols/liter.

The amount of the replenisher for the blix solution is from 30 ml to 200 ml, and preferably from 40 ml to 100 ml per square meter of the light-sensitive material. A bleaching agent and a fixing agent may be separately added to supply the replenisher for the blix solution.

The processing temperature for the blix step in the process of this invention is from 20° C. to 50° C., and preferably from 30° C. to 40° C. The processing time is from 20 seconds to 2 minutes, and preferably from 30 seconds to 1 minute.

Wash Step and/or Stabilization Step

The wash step and the stabilization step used in the present invention are described hereinafter in detail.

The amount of the replenisher used in the wash step or the stabilization step in this invention is from 1 to 50 times, and preferably from 3 to 20 times the volume amount of a processing solution carried with unit area of the light-sensitive material from the pre-bath.

The amount of the water replenisher solution and/or the stabilizer solution can be selected from a wide range according to the characteristics (e.g., couplers, etc.) and uses of the photographic light-sensitive materials, the temperature of the processing, and the type of replenishing system, (e.g., countercurrent system, regular system, etc.). In this case, the relation between the number of the wash tanks and the amount of water can be determined by the method described in *Journal of the Society of Motion Picture and Television Engineers,* Vol 64, pp. 248 to 253 (May, 1955). The stage number in the countercurrent system is preferably from 2 to 6, and more preferably from 2 to 4.

Accordingly, the preferred amount of the replenisher is from 300 ml to 1000 ml per square meter of the light-sensitive material in the case of 2 tank countercurrent system, from 100 ml to 500 ml in the case of 3 tank countercurrent system, and from 50 ml to 300 ml in the case of 4 tank countercurrent system. Also, the amount of the pre-bath component carried by a light-sensitive material is from about 20 ml to 60 ml per square meter of the light-sensitive material.

The water replenisher solution used in this invention can contain, e.g., isothiazolone compounds and cyanbendazoles described in JP-A-57-8542, chlorine series sterilizers such as chlorinated sodium isocyanurate, etc., described in JP-A-61-120145, benzotriazole described in JP-A-61-267761, copper ions, as well as the sterilizers described in Horishi Horiguchi, *Bookin Boobaizai no Kagaku* (*Antibacterial and Antifungal Chemistry*), *Biseibutsu no Mekkin Sakkin Boobai Gijutsu* (*Antibacterial and Antifungal Technology of Microorganisms*) edited by Eisei Gijutsu Kai, and *Bookin Boobai Zai Jiten* (*Handbook of Antibacterial And Anti-fungal Agents*), edited by Nippon Bookin Boobai Gakkai.

Furthermore, a surface active agent can be used as a wetting agent for the water replenisher solution, and a chelating agent such as ethylenediaminetetraacetic acid (EDTA) can be used as a water softener.

Once light-sensitive material has been blixed or fixed according to the present invention it can be processed by a stabilizer solution after the wash step or without undergoing a wash step.

The stabilization solution contains a compound having a function of stabilizing images. Examples of such a compound are aldehyde compounds such as formaldehyde, etc. buffers for adjusting pH of the photographic layers of the light-sensitive material suitable of stabilizing dyes, and ammonium compounds. Also, the stabilizing solution may further contain various kinds of sterilizers or antibacterial agents described above for imparting an antifungal property to the light-sensitive material after processing or for preventing the growth of bacteria in the solution.

Furthermore, the stabilization solution can contain a surface active agent, an optical whitening agent, and/or a hardening agent.

When processing the light-sensitive material according to the method of the present invention, the light-sensitive material is preferably processed by a stabilizer solution without undergoing a wash step. Known methods described in JP-A-57-8543, JP-A-58-14834, and JP-A-60-220345 can be used.

Furthermore, it is a preferred embodiment in this invention to use a chelating agent such as 1-hydroxyethylidene-1,1-diphosphonic acid, ethylenediaminetetramethylenephosphonic acid, etc., or a bismuth compound, as a stabilizer solution.

A wash step in this invention is sometimes called as rinse step.

In the wash step and/or the stabilization step in the present invention, it is preferred to reduce the concentration of calcium and magnesium in the replenisher to below 5 mg/liter.

That is, by reducing the concentration of calcium and magnesium in the replenisher, the content of calcium and magnesium in the wash tank and/or the stabilization tank is inevitably reduced, whereby the growth of fungi and bacteria is inhibited without using sterilizers and antifungal agents. Also, the problems of 1) staining the automatic processor's rollers and squeeze plate and 2) of precipitating deposits can be avoided.

In this invention, the concentration of calcium and magnesium in the replenisher for the wash step and/or the stabilization step is preferably less than 5 mg/liter, more preferably less than 3 mg/liter, and most preferably less than 1 mg/liter.

For adjusting the concentration of calcium and magnesium in the wash water or stabilization solution, various known methods can be used but the use of an ion exchange resin and/or a reverse osmosis apparatus is preferred.

As the aforesaid ion exchange resin, there are various kinds of cationic exchange resins but a cation exchange resin of an Na type capable of replacing sodium with calcium and magnesium is preferably used.

Also, an H type cationic exchange resin can be used but since in this case, the pH of the processing water becomes acid, it is preferred that an OH type anionic exchange resin is used together with an H type cationic exchange resin.

In addition, the aforesaid ion exchange resin is preferably a strong acid cation exchange resin having a styrene-divinylbenzene copolymer as the base and a sulfon group at the ion exchange group. Examples of the ion-exchange resin are Diaion SK-1B and Diaion PK-216 (trade names, made by Mitsubishi Chemical Industries Ltd.). It is preferred that at the time of production, the base material of this ion exchange resin contains from 4 to 16 wt % divinylbenzene per monomer. Examples of the anionic exchange resin which can be used in combination with the H-type cationic exchange resin preferably include a strong basic anion exchange resin having a styrene-divinylbenzene copolymer as the base material and a tertiary amine or quaternary ammonium group as the exchange group. Examples of such an anion exchange resin are Diaion SA-10A and Diaion PA-418 (trade names, made by Mitsubishi Chemical Industries Ltd.).

Also, in this invention, a reverse osmosis processing apparatus may be used for reducing the amount of the water replenisher solution and/or the stabilizer solution.

As the reverse osmosis apparatus, known apparatus can be used without any restriction, but it is preferred to use a very small apparatus having a reverse osmosis film area of less than 3 $m^2$ and pressure for use of less than 30 $kg/m^2$, and in particular less than 2 $m^2$ of the area and less than 20 $kg/m^2$ of the pressure. By using such a small apparatus, good workability and a sufficient water saving effect are obtained. Furthermore, the solution can be passed through activated carbon or a magnetic field.

In addition, as the reverse osmosis membrane for the reverse osmosis processing apparatus, a cellulose acetate film, an ethyl cellulose film, a polyacrylic acid film, a polyacrylonitrile film, a polyvinyl carbonate film, a polyether sulfone film, etc., can be used.

Also, the liquid sending pressure is usually from 5 $kg/cm^2$ to 60 $kg/cm^2$ but for attaining the object of the present invention, a pressure of less than 30 $kg/cm^2$ is sufficient and a so-called low-pressure type reverse osmosis apparatus (a pressure of less than 10 $kg/cm^2$) can be also sufficiently used in this invention.

As the structure of the reverse osmosis membrane, a spiral type, a tubular type, a hollow fiber type, a pleated type, a rod type, etc., can be used.

In this invention, at least one of the wash tank or stabilization tank, and the replenisher tank of each, may be irradiated by ultraviolet rays and, thereby, the growth of fungi can be further inhibited.

As the ultraviolet lamp being used for the aforesaid purpose, a low-pressure mercury vapor discharge tube generating line spectrum having a wave length of 253.7 n.m. can be used. In this invention, it is more preferred to use the aforesaid tube having from 0.5 watt to 7.5 watts in stearilizing power.

The ultraviolet lamp may be placed outside the tank or in the processing solution.

In this invention, sterilizers and/or antifungal agents may not be used for the water replenisher solution and/or the stabilizer solution, but these agents may be optionally used if the use thereof does not adversely effect the performance of the pre-bath.

The pH of water replenisher solution or the stabilizer solution is usually from 4 to 9, and preferably from 5 to 8. However, for certain purposes, an acid stabilizer solution (usually lower than pH 4) added with acetic acid, etc., is used.

The processing time for wash water or stabilization solution is explained hereinafter.

The time for washing or stabilization in this invention is from 10 seconds to 4 minutes but shorter time is preferred for effectively obtaining the effect of this invention and more preferably, the processing time is from 20 seconds to 3 minutes, and most preferably from 20 seconds to 2 minutes.

For the wash step or the stabilization step, it is preferred to use a combination of various kinds of wash accelerating means. As the accelerating means, ultrasonic generator in liquid, air foaming, spraying the liquid onto the light-sensitive material, compression by rollers, etc., can be used.

Also, the temperature of the washing step or the stabilization step is in the range of from 20° C. to 50° C., preferably from 25° C. to 45° C., and more preferably from 30° C. to 40° C.

The overflow liquid from the wash step and/or the stabilization step means a liquid overflow from a tank with replenishing to the tank, and for introducing the overflow liquid into the pre-bath, various methods can be employed. For example, a method of placing a slit at the upper portion between the pre-bath and the wall of the adjacent tank in an automatic processor and introducing the overflow liquid into the pre-bath through the slit, or a method of once storing the overflow liquid in a tank outside the automatic processor and supplying the liquid to the pre-bath using a pump may be used.

By thus introducing the overflow liquid into the pre-bath, a small amount of a more concentrated replenisher can be added to the pre-bath, and the components in the bath can be kept at a necessary concentration, whereby the amount of waste solution can be reduced by the volume corresponding to the concentration amount of the replenisher used for the pre-bath.

The same effect is obtained by storing the overflow liquid in a tank, adding the replenisher components thereto, and then using the finished liquid produced thereby.

Also, since the overflow liquid contains the components in the pre-bath, the absolute amount of the components being supplied to the pre-bath can be reduced by using the overflow liquid, whereby the load for environmental pollution and also the processing cost can be reduced.

The amount of the overflow liquid being introduced into the pre-bath can be optionally selected so as to conveniently control the concentration of the pre-bath but is usually from 0.2 to 5, preferably from 0.3 to 3, and more preferably from 0.5 to 2 as a mixing ratio of the overflow liquid to the amount of the replenisher for the pre-bath.

When in this invention, a water replenisher solution or a stabilizer solution is added to the color developer instead of wash water, it is preferred that a compound releasing ammonium ions such as ammonium chloride and aqueous ammonia is incorporated into the water replenisher solution or into the stabilization solution. This incorporation prevents the reduction of photographic properties.

The practical processing steps of the present invention are illustrated below but the steps of this invention are not limited thereto.

1. Color development - bleach - (wash) - blix - (wash) - (stabilization).
2. Color development - blix - (wash) - (stabilization).
3. Color development - bleach - blix - (wash) - (stabilization).

4. Color development - blix - blix - (wash) - (stabilization).

5. Color development - bleach - fix - blix - (wash) - (stabilization).

6. Black and white development - wash - (reversal) - color development - (control) - bleach - blix - (wash) - (stabilization).

7. Black and white development - wash - (reversal) - color development - (control) - blix - (wash) - (stabilization).

8. Black and white development - wash - (reversal) - color development - (control) - bleach - blix - (wash).

9. Color development - fix - blix - (wash).

10. Color development - fix - blix - blix - (wash).

In the aforesaid steps, the step enclosed by parentheses means a step which can be omitted according to the kind, object and use of the photographic light-sensitive material being processed, but the wash step and the stabilization step cannot stimultaneously be omitted even if both are enclosed by parentheses. Also, the wash step may be replaced with a stabilization step.

The method of this invention can be applied for processing any light-sensitive materials such as color photographic papers, color reversal photographic papers, direct positive color photographic materials, color positive photographic films, color negative photographic films, color reversal photographic films, etc., but in particular, the method of this invention is preferably applied for processing color photographic papers and color reversal photographic papers.

The silver halide color photographic materials which are processed by the method of the present invention are explained below in detail.

It is necessary that the light-sensitive material being processed by the process of this invention contains various color couplers. In this invention, a color coupler is a compound capable of forming a dye by causing a reaction with the oxidation product of an aromatic primary amine developing agent. Typical examples of the useful color couplers are naphtholic or phenolic compounds, pyrazolone or pyrazoloazole series compounds, and open-chained or heterocyclic ketomethylene compounds. Practical examples of the cyan, magenta, and yellow couplers which can be used in the present invention are described in the patents cited in *Research Disclosure,* (RD) 17643, Paragraph VII D, (December, 1978) and ibid, (RD) 18717 (November, 1979).

It is preferred that the color couplers incorporated in the light-sensitive materials have non-diffusibility by having a ballast group or by being polymerized. Also, in this invention, 2-equivalent color couplers having a releasable group at the active position are more preferred than 4-equivalent color couplers having a hydrogen atom at the active position since the above-mentioned 2-equivalent couplers can reduce the coating amount of silver and provide better results in accordance with the present invention. Couplers giving colored dyes having a proper diffusibility, non-coloring couplers, DIR couplers releasing a development inhibitor with coupling reaction, or couplers releasing a development accelerator with coupling reaction can also be used in this invention.

Typical examples of the yellow couplers used in the present invention include oil protect type acylacetamide series couplers and practical examples thereof are described in U.S. Pat. Nos. 2,407,210, 2,875,057, and 3,265,506.

In this invention, the use of 2-equivalent yellow couplers are preferred and typical examples thereof are oxygen atom-releasing type yellow couplers described in U.S. Pat. Nos. 3,408,194, 3,447,928, 3,933,501 and 4,022,620 and nitrogen atom-releasing type yellow couplers described in JP-B-58-10739, U.S. Pat. Nos. 4,401,752, 4,326,024, *Research Disclosure,* RD 18053 (April, 1979), British Patent 1,425,020, West German Patent Application (OLS) Nos. 2,219,917, 2,261,361, 2,329,587, and 2,433,812. Also, α-pivaloylacetanilide series couplers are excellent with respect to fastness, in particular, light fastness of colored dyes formed, while α-benzoylacetanilide series couplers give high color density.

Examples of the magenta couplers which can be used in the present invention include oil protect type indazolone series and cyanoacetyl series, and preferably pyrazoloazole series couplers such as 5-pyrazolone series and pyrazolotriazole series couplers. The 5-pyrazolone series couplers having an arylamino group or an acylamino group at the 3-position are preferred from the viewpoint of hue and color density of the colored dyes formed. Typical examples are described in U.S. Pat. Nos. 2,311,082, 2,343,703, 2,600,788, 2,908,573, 3,062,653, 3,152,896, and 3,936,015. As the releasable group for the 2-equivalent 5-pyrazolone series couplers, the nitrogen atom-releasing group described in U.S. Pat. No. 4,310,619 and the arylthio group described in U.S. Pat. No. 4,351,897 are preferred. Also, the 5-pyrazolone series couplers having a ballast group described in European Patent 73,636 give a high color density.

Examples of the pyrazoloazole series magenta couplers which can be used in the present invention include pyrazolobenzimidazoles described in U.S. Pat. No. 3,369,879, and preferably include pyrazolo[5,1-c]-[1,2,4]triazoles described in U.S. Pat. No. 3,725,067, pyrazolotetrazoles described in *Research Disclosure,* No. 24220 (June, 1984), and pyrazolopyrazoles described in *Research Disclosure,* No. 24230 (June, 1984). Also, from the standpoint of less yellow side adsorption and high light-fastness of color dyes formed, the imidazo[1,2-b]pyrazoles described in European Patent 119,741 are preferred and the pyrazolo[1,5-b][1,2,4]triazoles described in European Patent 119,860 are particularly preferred.

Examples of the cyan couplers which can be used in the present invention include oilprotect type naphtholic and phenolic couplers.

Typical naphtholic couplers are the naphtholic couplers described in U.S. Pat. No. 2,474,293 and preferably oxygen atom-releasing type 2-equivalent naphtholic couplers described in U.S. Pat. No. 4,052,212, 4,146,396, 4,228,233, and 4,296,200. Also, practical examples of phenolic couplers are described in U.S. Pat. Nos. 2,369,929, 2,801,171, 2,772,162, and 2,895,826.

Cyan couplers having fastness to humidity and heat are preferably used in the present invention and typical examples thereof are phenolic cyan couplers having an alkyl group of two or more carbon atoms at the meta-position of the phenol nucleus described in U.S. Pat. No. 3,772,002, 2,5-diacylamino-substituted phenolic couplers described in U.S. Pat. Nos. 2,772,162, 3,758,308, 4,126,396, 4,334,011, and 4,327,173, West German Patent Application (OLS) No. 3,329,729, and JP-A-59-166956, and phenolic couplers having a phenylureido group at the 2-position and an acylamino group at the 5-position described in U.S. Pat. Nos. 3,446,622, 4,333,999, 4,451,559, and 4,427,767.

In this invention, if necessary various kinds of couplers may be used together. Also the graininess can be improved by using a coupler which yields a colored dye which has a proper diffusibility with ordinary couplers. Examples of couplers yielding diffusible dyes include magenta couplers described in U.S. Pat. No. 4,366,237 and British Patent 2,125,570 and yellow, magenta, and cyan couplers described in European Patent 96,570 and West German Patent Application (OLS) No. 3,234,533.

The dye-forming couplers and the aforesaid specific couplers may form dimers or more polymers. Typical examples of the polymerized dye-forming couplers are described in U.S. Pat. Nos. 3,451,820 and 4,080,211. Also, practical examples of the polymerized magenta couplers are described in British Patent 2,102,173 and U.S. Pat. No. 4,367,282.

To attain the characteristics required for color photographic materials, two or more kinds of the aforesaid couplers may exist in a same photosensitive emulsion layer or two or more of the same kind of coupler may exist in two or more emulsion layer.

A standard amount of the color coupler is in the range of from 0.001 mol to 1 mol per mol of the light-sensitive silver halide in the silver halide emulsion layer, with from 0.01 mol to 0.5 mol of a yellow coupler, from 0.003 mol to 0.3 mol of a magenta coupler, and from 0.002 mol to 0.3 mol of a cyan coupler being preferred amounts.

The couplers used in the present invention can be introduced into the color photographic materials by various dispersion methods. Examples include an oil drop-in-water dispersion method and a latex dispersion method. Examples of a high-boiling organic solvent for the oil drop-in-water dispersion method are described in U.S. Pat. No. 2,322,027, etc., and practical examples of the process and effect of the latex dispersion method and the latexes for impregnation are described in U.S. Pat. No. 4,199,363 and West German Patent Application (OLS) Nos. 2,541,274 and 2,541,230.

The silver halide emulsions of the light-sensitive materials used in the present invention may contain any halide composition such as silver iodobromide, silver bromide, silver chlorobromide, silver chloride, etc. For example, in the case of quick processing or low-replenish processing, color photographic papers, a silver chlorobromide emulsion containing at least 60 mol% silver chloride or a silver chloride emulsion is preferred, and the aforesaid emulsions having a silver chloride content of from 80 to 100 mol % are more preferred. Also, in the case of requiring high speed and forming particularly low fog during the production, storage and/or processing the light-sensitive materials, a silver chlorobromide emulsion containing at least 50 mol % silver bromide or a silver bromide emulsion (the emulsions may contain less than 3 mol % silver iodide), and particularly those containing at least 70 mol % silver bromide are preferred. For the color photographic materials for camera use, a silver iodobromide emulsion or a silver chloroiodobromide containing from 3 to 15 mol % silver iodide is preferred.

The silver halide grains for use in this invention may have a different phase between the inside and the surface layer thereof, may be a multiphase structure having a junction structure, or may be composed of a uniform phase throughout the whole grain. Also, the silver halide grains may be composed of a mixture thereof.

The mean grain size distribution of the silver halide grains for use in this invention may be narrow or broad but a so-called mono-disperse silver halide emulsion wherein the value (coefficient of variation) of the standard deviation in the grain size distribution curve divided by the mean grain size is within 20%, and particularly preferably within 15% is preferably used. Also, for meeting the gradation required for the light-sensitive materials, two or more kinds of mono-dispersed silver halide emulsions (preferably having the aforesaid coefficient of variation) each having different mean grain size can be coated in a same layer or different layers which have a substantially same light-sensitivity. Furthermore, a combination of two or more kinds of poly-dispersed silver halide emulsions or a combination of a mono-dispersed emulsion and a poly-dispersed emulsion can be used for one layer or a multilayer.

The silver halide grains for use in this invention may have a regular crystal form such as cubic, octahedral, dodecahedral, tetradecahedral, etc., an irregular crystal form such as spherical, etc., or a composite form of these crystal forms. Also, the silver halide grains may be tabular grains and in this case, a tabular grain silver halide emulsion wherein tabular silver halide grains having an aspect ratio (length/thickness) of from 5 to 8, or at least 8 account for at least 50% of the total projected area of the silver halide grains can be used. The emulsion may be composed of these various crystal forms.

The silver halide emulsion for use in this invention may be of a surface latent image type, forming latent images mainly on the surface thereof, or an inside latent image type, forming mainly in the inside thereof.

The silver halide photographic emulsion for use in this invention can be prepared by the methods described in *Research Disclosure,* Vol. 170, No. 17643, Paragraphs I, II, and III (December, 1978).

The emulsion for use in this invention is usually chemical ripened and spectrally sensitizing after physical ripening. The additives used for these steps are described in *Research Disclosure,* Vol. 176, No. 17643 (December, 1979) and Ibid., Vol. 187, No. 18716 (November, 1979) and they are shown in the following table together other photographic additives.

| Additive | RD 17643 | RD 18716 |
|---|---|---|
| 1. Chemical sensitizer | Page 23 | Page 648, right column |
| 2. Sensitivity increasing agent | — | Page 648, right column |
| 3. Spectral sensitizer | Pages 23–24 | Page 648, right column to page 649, right column |
| 4. Super dye sensitizer | — | Page, 649, right column |
| 5. Whitening agent | Page 24 | — |
| 6. Antifoggant and stabilizer | Pages 24–25 | Page 649, right column |
| 7. Coupler | Page 25 | — |
| 8. Organic solvent | Page 25 | — |
| 9. Light absorbent and filter dye and ultra-violet absorbent | Pages 25–26 | Page 649, right column to page 650, left column |
| 10. Stain inhibitor | Page 25, right column | Page 650, left to right columns |
| 11. Dye image stabilizer | Page 25 | — |
| 12. Hardening agent | Page 26 | Page 651, left column |
| 13. Binder | Page 26 | Page 651, |

-continued

| Additive | RD 17643 | RD 18716 |
|---|---|---|
| | | left column |
| 14. Plasticizer, wetting agent | Page 27 | Page 650, right column |
| 15. Coating aid and surface active agent | Pages 26–27 | Page 650, right column |
| 16. Antistatic agent | Page 27 | Page 650, right column |

The aforesaid photographic emulsions are coated on a flexible support such as a plastic film (films of cellulose nitrate, cellulose, acetate, polyethylene terephthalate, etc.,), papers, etc., or a solid support such as glass plates, etc. Details of the supports and coating methods are described in *Research Disclosure,* Vol. 176, No. 17643, XV(page 27) and XVII(page 28) (December, 1978).

In this invention, reflecting supports are preferably used.

The "reflecting support" is a support having high reflectivity for clearly showing dye image formed in the silver halide emulsion layers formed thereon. Such a reflecting support includes a support having coated thereon a hydrophobic resin containing therein a light reflecting material such as titanium oxide, zinc oxide, calcium carbonate, calcium sulfate, etc., and a support composed of a hydrophobic resin containing therein the aforesaid light-reflecting material.

The invention is further explained in detail based on the following examples, but is not to be construed as being limited thereto.

EXAMPLE 1

A multilayer color photographic paper (Sample 101) having the layers shown below on a paper support both surfaces of which were coated with polyethylene was prepared.

In addition, the coating compositions for the layers were prepared as follows.

Preparation of the Coating Composition for Layer 1

In 27.2 ml of ethyl acetate and 7.7 ml (8.0 g) of a high-boiling solvent (Solv-1) were dissolved 19.1 g of a yellow coupler (ExY-1) and 4.4 g of a dye image stabilizer (Cpd-1) and the solution was dispersed by emulsification in 185 ml of an aqueous 10% gelatin solution containing 8 ml of an aqueous solution of 10% sodium dodecylbenzenesulfonate. The emulsified dispersion was mixed with Emulsion EM 7 and Emulsion EM 8 and the concentration of gelatin was adjusted a shown below to provide the coating composition for layer 1.

The coating compositions for Layer 2 to Layer 7 were also prepared in a manner similar to the above.

In addition, for each layer, 1-oxy-3,5-dichloro-s-triazine sodium salt was used as a gelatin hardening agent and (Cpd-1) was used as a tackifier.

Layer Construction

The composition of each layer is shown below. The numerals indicate the coating amount (g/m$^2$), wherein the amount of each silver halide emulsion is expressed as the calculated silver amount present (g/m$^2$).

Also, the polyethylene coating on the emulsion side contained a white pigment ($TiO_2$) and a bluish dye.

| | |
|---|---|
| Layer 1 Blue-sensitive Emulsion Layer | |
| Mono-dispersed silver chlorobromide emulsion (EM 7) spectrally sensitized by sensitizing dye (ExS-1) | 0.15 |
| Mono-dispersed silver chlorobromide emulsion (EM 8) spectrally sensitized by sensitizing dye (ExS-1) | 0.15 |
| Gelatin | 1.86 |
| Yellow coupler (ExY-1) | 0.82 |
| Dye image stabilizer (Cpd-2) | 0.19 |
| Solvent (Solv-1) | 0.35 |
| Layer 2 Color Mixing Inhibiting Layer | |
| Gelatin | 0.99 |
| Color mixing inhibitor (Cpd-3) | 0.08 |
| Layer 3 Green-sensitive Emulsion Layer | |
| Mono-dispersed silver chlorobromide emulsion (EM 9) spectrally sensitized by sensitizing dyes (ExS-2 and 3) | 0.12 |
| Mono-dispersed silver chlorobromide emulsion (EM 10) spectrally sensitized by sensitizing dyes (ExS-2 and 3) | 0.24 |
| Gelatin | 1.24 |
| Magenta coupler (ExM-1) | 0.39 |
| Dye image stabilizer (Cpd-4) | 0.25 |
| Dye image stabilizer (Cpd-5) | 0.12 |
| Solvent (Solv-2) | 0.25 |
| Layer 4 Ultraviolet Absorption Layer | |
| Gelatin | 1.60 |
| Ultraviolet absorbents (Cpd-6/Cpd-7/Cpd-8 = 3/2/6 by weight ratio) | 0.70 |
| Color mixing inhibitor (Cpd-9) | 0.05 |
| Solvent (Solv-3) | 0.42 |
| Layer 5 Red-sensitive Emulsion Layer | |
| Mono-dispersed silver chlorobromide emulsion (EM 11) spectrally sensitized by sensitizing dyes (ExS-4 and 5) | 0.07 |
| Mono-dispersed silver chlorobromide emulsion (EM 12) spectrally sensitized by sensitizing dyes (ExS-4 and 5) | 0.16 |
| Gelatin | 0.92 |
| Cyan coupler (ExC-1) | 1.46 |
| Color image stabilizers (Cpd-7/Cpd-8/Cpd-10 = 3/4/2 by weight ratio) | 0.17 |
| Dispersing polymer (Cpd-11) | 0.14 |
| Solvent (Solv-1) | 0.20 |
| Layer 6 Ultraviolet Absorption Layer | |
| Gelatin | 0.54 |
| Ultraviolet absorbents (Cpd-6/Cpd-8/Cpd-10 = 1/5/3 by weight ratio) | 0.21 |
| Solvent (Solv-4) | 0.08 |
| Layer 7 Protective Layer | |
| Gelatin | 1.33 |
| Acryl-modified copolymer of polyvinyl alcohol (modified degree 17%) | 0.17 |
| Fluid paraffin | 0.03 |

Also, in this case, (Cpd-12) and (Cpd-13) were used as irradiation inhibiting dyes.

Furthermore, for each layer Alkanol XC (trade name, made by Du Pont), sodium alkylbenzenesulfonate, succinic acid ester, and Magefacx F-120 (trade name, made by Dainippon Ink and Chemicals, Inc.) were used as emulsion-dispersing agents and coating aids. Also, Cpd-14 and 15 were used as the stabilizers for silver halide.

The details of the emulsions used were as follows.

| Emulsion | Form | Grain Size (μm) | Br-Content (mol %) | Coefficient of variation* |
|---|---|---|---|---|
| EM 7 | Cubic | 1.1 | 1.0 | 0.10 |
| EM 8 | Cubic | 0.8 | 1.0 | 0.10 |
| EM 9 | Cubic | 0.45 | 1.5 | 0.09 |
| EM 10 | Cubic | 0.34 | 1.5 | 0.09 |
| EM 11 | Cubic | 0.45 | 1.5 | 0.09 |

-continued
| Emulsion | Form | Grain Size (μm) | Br-Content (mol %) | Coefficient of variation* |
|---|---|---|---|---|
| EM 12 | Cubic | 0.34 | 1.6 | 0.10 |
*Coefficient of Variation = [standard deviation]/[average grain size]
The chemicals used for preparing the color photographic paper were as follows.
ExY-1
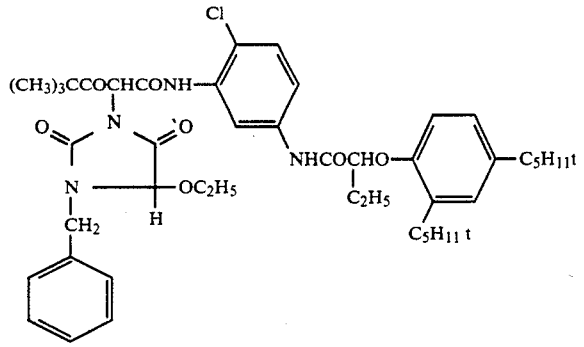
ExM-1
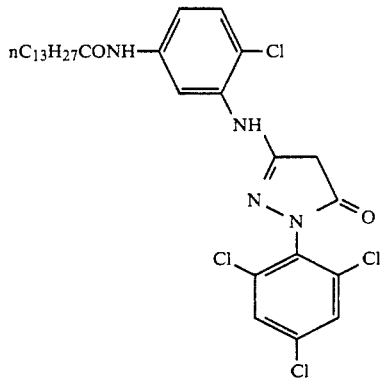
ExC-1
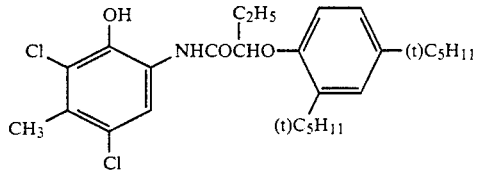
ExS-1
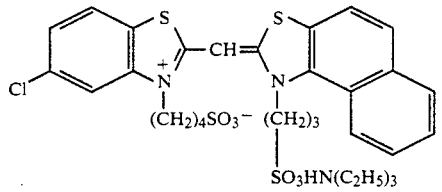
ExS-2
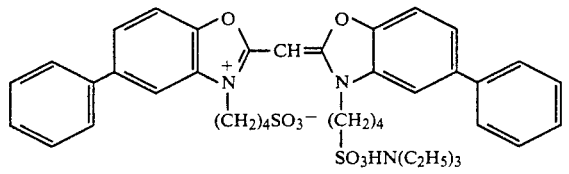
ExS-3
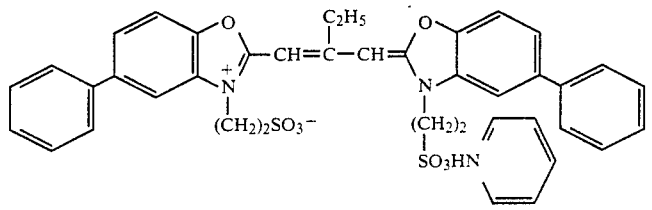

-continued
ExS-4
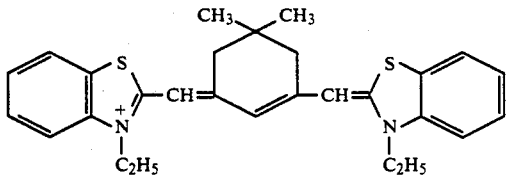
ExS-5
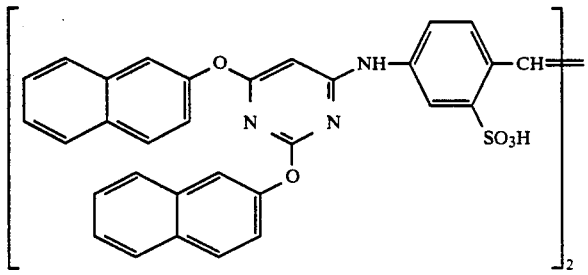
Cpd-1
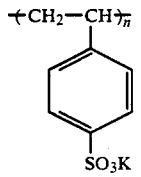
(n = 100 to 1000)
Cpd-2
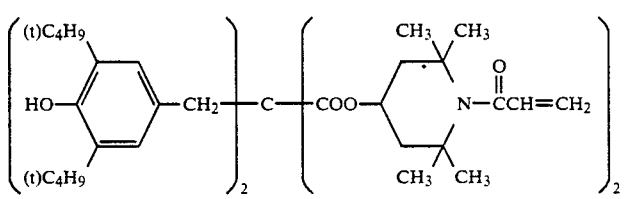
Cpd-3
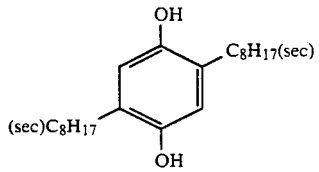
Cpd-4
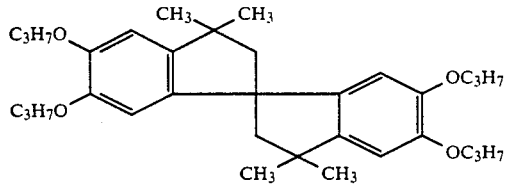
Cpd-5
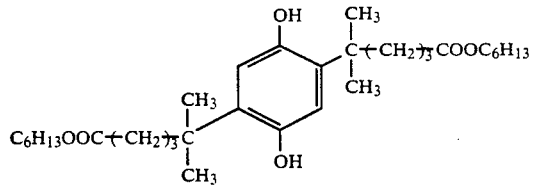
Cpd-6
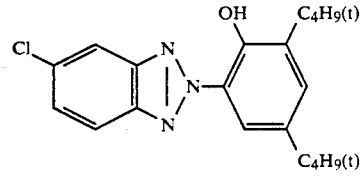

-continued
Cpd-7
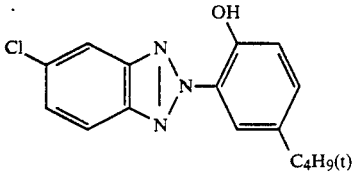
Cpd-8
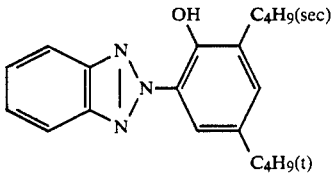
Cpd-9
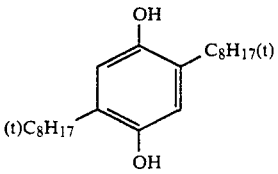
Cpd-10
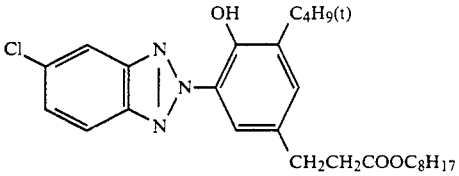
Cpd-11
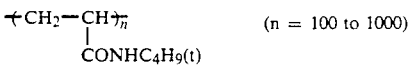
(n = 100 to 1000)
Cpd-12
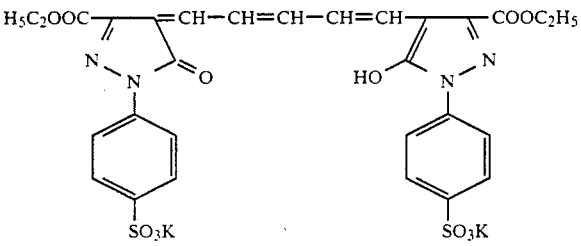
Cpd-13
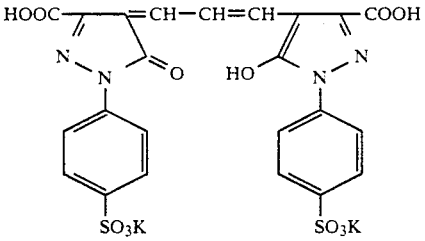
Cpd-14
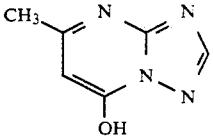
Cpd-15
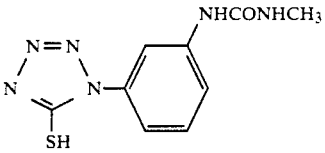

| | |
|---|---|
| Solv-1 Dibutyl Phthalate | |
| Solv-2 Trioctyl Phosphate | |
| Solv-3 Trinonyl Phosphate | |
| Solv-4 Tricresyl Phosphate | |

Sample 101 thus obtained was imagewise exposed and subjected to continuous processing using an automatic processor until the accumulated amount of the replenisher for the color developer became 3 times the tank volume. The processed amount of the sample was 5 $m^2$ per day. The processing steps were as follows.

Process A

| Processing Step | Temperature (°C.) | Time | Replenisher* Amount (ml) | Tank Volume (l) |
|---|---|---|---|---|
| Color developer | 35 | 45 sec. | 80 | 10 |
| Blix | 30 to 36 | 45 sec. | 60 ← | 10 |
| Wash (1) | 30 to 37 | 20 sec. | — ← | 5 |
| Wash (2) | 30 to 37 | 20 sec. | — ← | 5 |
| Wash (3) | 30 to 37 | 20 sec. | — ← | 5 |
| Wash (4) | 30 to 37 | 30 sec. | 100 | 5 |
| Drying | 70 to 85 | 60 sec. | | |

*The replenisher amount per square meter of the color photographic paper.

Also, as shown by the arrows, a countercurrent replenishing system of introducing the overflow liquid of wash water into the pre-bath was employed and the overflow liquid from wash water (1) was introduced into the blix solution.

The continuous processing was performed in a room having temperature of 20° C., humidity of 75%, and carbon dioxide concentration of 1200 ppm. The size of the opened area of the automatic processor used was 0.02 ($cm^2$/ml) and the evaporated amount was 60 ml/day. In addition, the working time was 10 hours.

The compositions of the processing solutions were as follows.

| Color Developer | Tank Liquid | Replenisher |
|---|---|---|
| Water | 800 ml | 800 ml |
| Ethylenediaminetetraacetic acid | 5.0 g | 5.0 g |
| 5,6-Dihydroxybenzene-1,2,4-trisulfonic acid | 0.3 g | 0.3 g |
| Sodium chloride | 0.4 g | — |
| Potassium carbonate | 25 g | 25 g |
| N-Ethyl-N-(β-methanesulfonamidoethyl)-3-methyl-4-aminoaniline sulfate | 5.0 g | 10.0 g |
| Preservative A (shown in Table 1) | 0.03 mol | 0.05 mol |
| Preservative B (shown in Table 1) | 0.04 mol | 0.04 mol |
| Optical whitening agent (4,4'-diaminostilbene series) | 2.0 g | 4.5 g |
| Water to make | 1000 ml | 1000 ml |
| pH (25° C.) | 10.05 | 10.85 |

| Blix Solution (tank liquid and replenisher had same composition) | |
|---|---|
| Water | 400 ml |
| Ammonium thiosulfate (70%) | 200 ml |
| Sodium p-methylsulfinate | 25 g |
| Sodium sulfite | 20 g |
| Ethylenediaminetetraacetic acid iron(III) ammonium | 100 g |
| Ethylenediaminetetraacetic acid di-sodium | 5 g |
| Glacial acid | 7 g |
| Water to make | 1000 ml |
| pH (25° C.) | 5.80 |

Wash Water (tank liquid and replenisher had same composition)

City tap water was passed through a mixed bed type column packed with an H-type strong basic cation exchange resin (Amberlite IR-120B, made by Rohm & Haas Co.) and an OH-type anion exchange resin (Amberlite IR-400) to give pure water having the following quality:

| | |
|---|---|
| Calcium | 0.3 mg/l |
| Magnesium | below 0.1 mg/l |
| pH | 6.5 |
| Electrical conductivity | 5.0 μs/cm |

Then, the same continuous process as above was performed except that the water replenisher solution was added to the color developer at 40 ml every day after finishing the processing of each day (process B).

Furthermore, the same continuous process as in Process A was performed while changing the preservatives in the color developer, as shown in Table 1 below (Process C).

Moreover, the continuous processing as in Process B was performed while changing the preservatives (Processes D to Q).

Then, before and after each continuous processing, the density change of the magenta image ($\Delta DG_{min}$ and $\Delta DG_{max}$) and the change of the yellow image density ($\Delta CB_{1.0}$) at the point of 1.0 in magenta image density were determined. The results obtained are shown in Table 1.

TABLE 1

| | Continuous Processing | | | | Change of Photographic property | | |
|---|---|---|---|---|---|---|---|
| No. | Process | Added amount of solution (ml/day) | Preservative A | Preservative B | $\Delta D_{Gmin}$ | $\Delta D_{Gmax}$ | $\Delta CB_{1.0}$ |
| 1 (Comparison) | A | — | Hydroxylamine* | Potassium sulfite | +0.10 | +0.22 | +0.18 |
| 2 (Comparison) | B | 40 | Hydroxylamine* | Potassium sulfite | +0.09 | +0.20 | +0.15 |
| 3 (Comparison) | C | — | I-1 | VII-1 | +0.06 | +0.10 | +0.12 |
| 4 (Invention) | D | 40 | " | " | +0.02 | +0.05 | +0.04 |
| 5 (Invention) | E | 40 | I-2 | XVI-7 | +0.03 | +0.06 | +0.03 |
| 6 (Invention) | F | 40 | II-2 | VIII-1 | +0.01 | +0.03 | +0.05 |
| 7 (Invention) | G | 40 | III-7 | VII-1 | +0.02 | +0.04 | +0.07 |

TABLE 1-continued

| No. | Continuous Processing: Process | Added amount of solution (ml/day) | Preservative A | Preservative B | Change of Photographic property: $\Delta D_{Gmin}$ | $\Delta D_{Gmax}$ | $\Delta CB_{1.0}$ |
|---|---|---|---|---|---|---|---|
| 8 (Invention) | H | 40 | III-7 | XVI-7 | +0.03 | +0.06 | +0.06 |
| 9 (Invention) | I | 40 | III-12 | VII-1 | +0.01 | +0.03 | +0.01 |
| 10 (Invention) | J | 40 | IV-3 | " | 0.00 | +0.02 | +0.03 |
| 11 (Invention) | K | 40 | V-1 | " | +0.01 | +0.04 | +0.05 |
| 12 (Invention) | L | 40 | V-2 | " | +0.02 | +0.02 | +0.02 |
| 13 (Invention) | M | 40 | VI-5 | " | +0.01 | +0.05 | +0.04 |
| 14 (Invention) | N | 40 | I-1 | VIII-1 | 0.00 | +0.01 | +0.03 |
| 15 (Invention) | O | 40 | " | IX-3 | +0.03 | +0.04 | +0.05 |
| 16 (Invention) | P | 40 | " | X-1 | +0.03 | +0.03 | +0.06 |
| 17 (Invention) | Q | 40 | " | XI-1 | +0.02 | +0.03 | +0.04 |

*as Sulfate

As is clear from Table 1 described above, by the process of this invention, preferred results of showing less change of photographic performance by the continuous processing were obtained. Also, in the case of using the color developer using hydroxylamine sulfate and potassium sulfite as conventional preservatives for the color developer, there was less deviation in the photographic properties but the deviation was still unacceptable.

EXAMPLE 2

By following the same procedure as No. 7 of Example 1 while using each of compounds VII-3, VIII-1, VIII-6, IX-3, IX-4, X-3, X-8, XI-1, XI-2, XII-2, XII-10, XIII-1, XIII-6, XIV-1, XIV-3, XV-1, XV-2, XVI-1, and XVI-11 for the preservative B, similar excellent results were obtained. Among them, the results obtained by using VII-3, XVI-1 or XVI-11 were excellent.

EXAMPLE 3

A multilayer color photographic material (Sample 301) having the following layers on a cellulose triacetate film support sub-coated was prepared.

Composition of Layers

The coated amount is shown as g/m$^2$ units of silver for silver halide (emulsion) and colloid silver, as g/m$^2$ units for couplers, additives, and gelatin, and as mol number per mol of silver halide in a same layer for sensitizing dyes.

| | |
|---|---|
| Layer 1 Antihalation Layer | |
| Black colloid silver | 0.2 |
| Gelatin | 1.3 |
| ExM-8 | 0.06 |
| UV-1 | 0.1 |
| UV-2 | 0.2 |
| Solv-1 | 0.01 |
| Solv-2 | 0.01 |
| Layer 2 Interlayer | |
| Fine grain silver bromide (mean grain size = 0.07 μm) | 0.10 |
| Gelatin | 1.5 |
| UV-1 | 0.06 |
| UV-2 | 0.03 |
| ExC-2 | 0.02 |
| ExF-1 | 0.004 |
| Solv-1 | 0.1 |
| Solv-2 | 0.09 |
| Layer 3 1st Red-sensitive Emulsion Layer | |
| Silver iodobromide emulsion (AgI 2 mol %, inside high-AgI type, sphere-corresponding diameter 0.3 μm, coefficient of variation of sphere-corresponding diameters 29%, normal crystal, twin-mixed grains, aspect ratio 2.5) | 0.4 as silver |
| Gelatin | 0.6 |
| ExS-1 | $1.0 \times 10^{-4}$ |
| ExS-2 | $3.0 \times 10^{-4}$ |
| ExS-3 | $1.0 \times 10^{-5}$ |
| ExC-3 | 0.06 |
| ExC-4 | 0.06 |
| ExC-7 | 0.04 |
| ExC-2 | 0.03 |
| Solv-1 | 0.03 |
| Solv-3 | 0.012 |
| Layer 4 2nd Red-sensitive Emulsion Layer | |
| Silver iodobromide emulsion (AgI 5 mol %, inside high-AgI type, sphere-corresponding diameter 0.7 μm, coefficient of variation of sphere-corresponding diameters 25%, normal crystal, twin-mixed grains, aspect ratio 4) | 0.7 as silver |
| ExS-1 | $1.0 \times 10^{-4}$ |
| ExS-2 | $3.0 \times 10^{-4}$ |
| ExS-3 | $1.0 \times 10^{-5}$ |
| ExC-3 | 0.24 |
| ExC-4 | 0.24 |
| ExC-7 | 0.04 |
| ExC-2 | 0.04 |
| Solv-1 | 0.15 |
| Solv-3 | 0.02 |
| Layer 5 3rd Red-sensitive Emulsion Layer | |
| Silver iodobromide emulsion (AgI 10 mol %, inside high-AgI type, sphere-corresponding diameter 0.8 μm, coefficient of variation of sphere-corresponding diameters 16%, normal crystal, twin-mixed grains, aspect ratio 1.3) | 1.0 as silver |
| Gelatin | 1.0 |
| ExS-1 | $1.0 \times 10^{-4}$ |
| ExS-2 | $3.0 \times 10^{-4}$ |
| ExS-3 | $1.0 \times 10^{-5}$ |
| ExC-5 | 0.05 |
| ExC-6 | 0.1 |
| Solv-1 | 0.01 |
| Solv-3 | 0.05 |
| Layer 6 Interlayer | |
| Gelatin | 1.0 |
| Cpd-1 | 0.03 |
| Solv-1 | 0.05 |
| Layer 7 1st Green-sensitive Emulsion Layer | |
| Silver iodobromide emulsion (AgI 2 mol %, inside high-AgI type, sphere-corresponding diameter 0.3 μm, coefficient of variation of sphere-corresponding diameters, normal crystal, twin-mixed grains, aspect ratio 2.5) | 0.30 as silver |
| ExS-4 | $5.0 \times 10^{-4}$ |
| ExS-6 | $0.3 \times 10^{-4}$ |
| ExS-5 | $2.0 \times 10^{-4}$ |
| Gelatin | 1.0 |

-continued

| | |
|---|---|
| ExM-9 | 0.2 |
| ExY-14 | 0.03 |
| ExM-8 | 0.03 |
| Solv-1 | 0.5 |
| Layer 8 2nd Green-sensitive Emulsion Layer | |
| Silver iodobromide emulsion (AgI 4 mol %, inside high-AgI type, sphere-corresponding diameter 0.6 μm, coefficient of variation of sphere-corresponding diameters 38%, normal crystal, twin-mixed grains, aspect ratio 4) | 0.4 as silver |
| ExS-4 | $5.0 \times 10^{-4}$ |
| ExS-5 | $2.0 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-14 | 0.01 |
| Solv-1 | 0.2 |
| Layer 9 3rd Green-sensitive Emulsion Layer | |
| Silver iodobromide emulsion (AgI 6 mol %, inside high-AgI type, sphere-corresponding diameter 1.0 μm, coefficient of variation of sphere-corresponding diameters 80%, normal crystal, twin-mixed grains, aspect ratio 1.2) | 0.85 as silver |
| Gelatin | 1.0 |
| ExS-7 | $3.5 \times 10^{-4}$ |
| ExS-8 | $1.4 \times 10^{-4}$ |
| ExM-11 | 0.01 |
| ExM-12 | 0.03 |
| ExM-13 | 0.20 |
| ExM-8 | 0.02 |
| ExY-15 | 0.02 |
| Solv-1 | 0.20 |
| Solv-2 | 0.05 |
| Layer 10 Yellow Filter Layer | |
| Gelatin | 1.2 |
| Yellow colloid silver | 0.08 |
| Cpd-2 | 0.1 |
| Solv-1 | 0.3 |

-continued

| | |
|---|---|
| Layer 11 1st Blue-sensitive Emulsion Layer | |
| Silver iodobromide emulsion (AgI 4 mol %, inside high-AgI type, sphere-corresponding diameter 0.5 μm, coefficient of variation of sphere-corresponding diameters 15%, octahedral grains) | 0.4 as silver |
| Gelatin | 1.0 |
| ExS-9 | $2.0 \times 10^{-4}$ |
| ExY-16 | 0.9 |
| ExY-14 | 0.07 |
| Solv-1 | 0.2 |
| Layer 12 2nd Blue-sensitive Emulsion Layer | |
| Silver iodobromide emulsion (AgI 10 mol %, inside high-AgI type, sphere-corresponding diameter 1.3 μm, coefficient of variation of sphere-corresponding diameters 25%, normal crystal, twin-mixed grains, aspect ratio 4.5) | 0.5 as silver |
| Gelatin | 0.6 |
| ExS-9 | $1.0 \times 10^{-4}$ |
| ExY-16 | 0.25 |
| Solv-1 | 0.07 |
| Layer 13 1st Protective Layer | |
| Gelatin | 0.8 |
| UV-1 | 0.1 |
| UV-2 | 0.2 |
| Solv-1 | 0.01 |
| Solv-2 | 0.01 |
| Layer 14 2nd Protective Layer | |
| Fine grain silver bromide (mean grain size 0.07 μm) | 0.5 |
| Gelatin | 0.45 |
| Polymethyl methacrylate particles (diameter 1.5 μm) | 0.2 |
| H-1 | 0.4 |
| Cpd-3 | 0.5 |
| Cpd-4 | 0.5 |

Each layer further contained a surface active agent as a coating aid. Thus, Sample 301 was prepared.

The compounds used in the above layers were as follows:

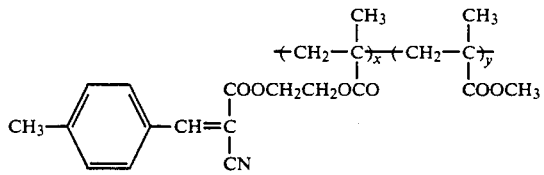

UV-1 x/y = 7/3 (weight ratio)

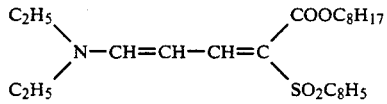

UV-2

Tricresyl Phosphate — Solv-1

Dibutyl Phthalate — Solv-2

Bis(2-ethylhexyl) Phthalate — Solv-3

-continued
ExM-8
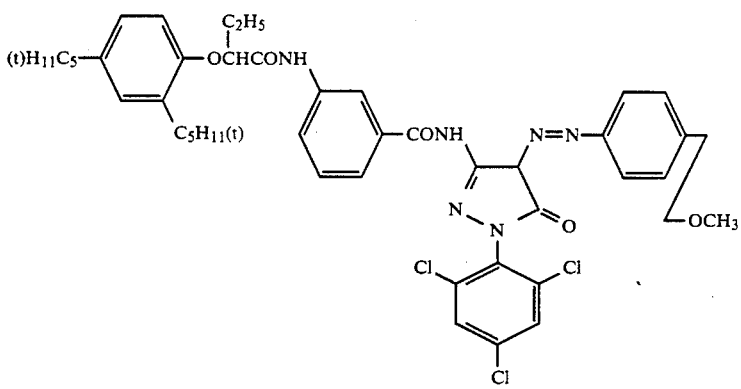
ExF-1
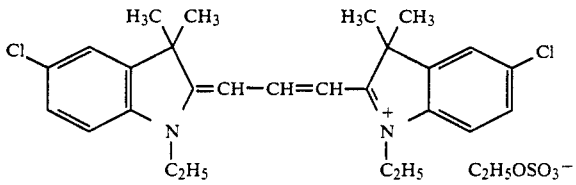
ExC-2
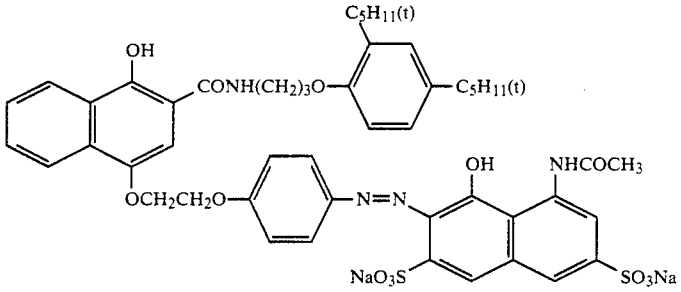
ExC-3
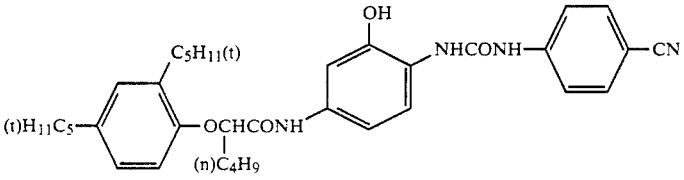
ExC-4
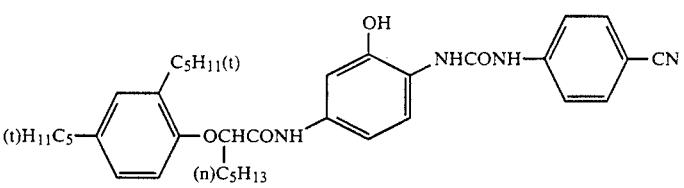
ExY-14
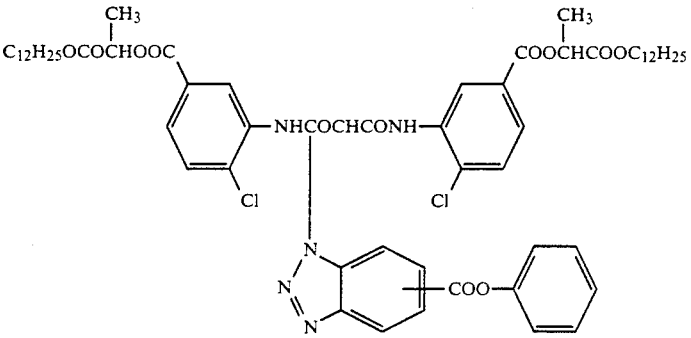

-continued
ExY-15
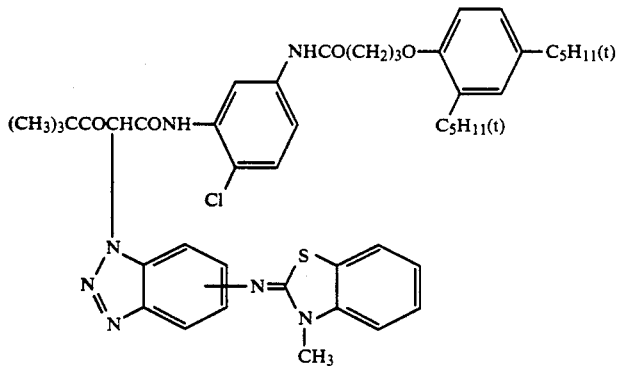
ExC-5
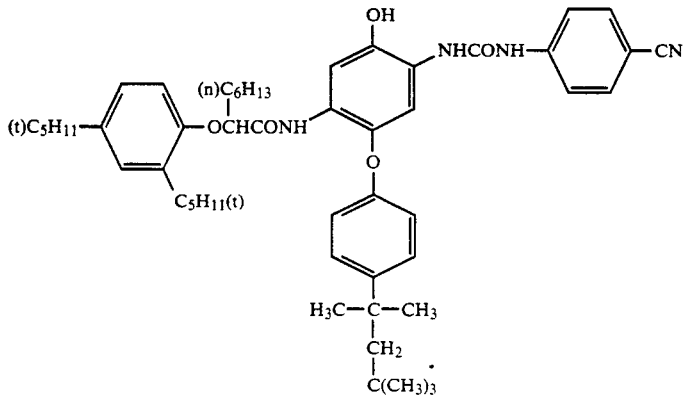
ExC-6
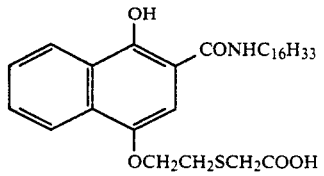
ExC-7
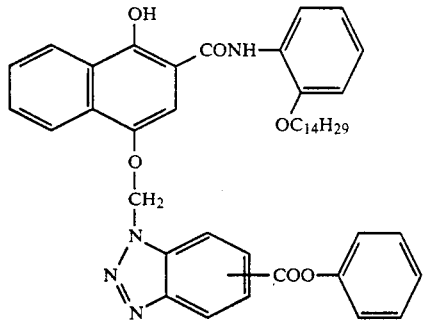
ExM-9
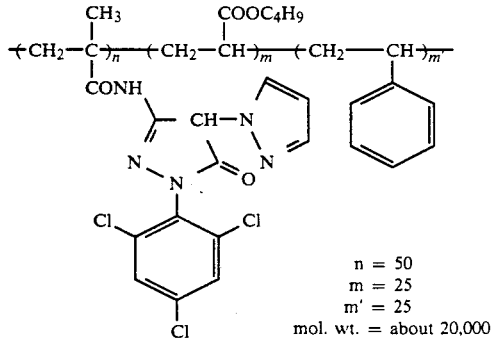
n = 50
m = 25
m' = 25
mol. wt. = about 20,000

-continued
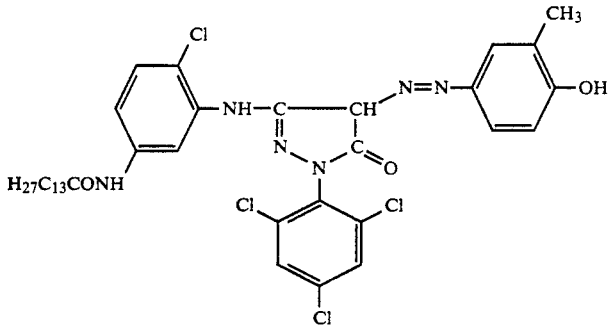
ExM-10
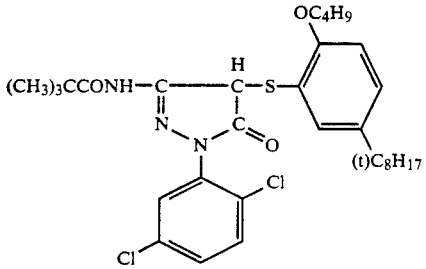
ExM-11
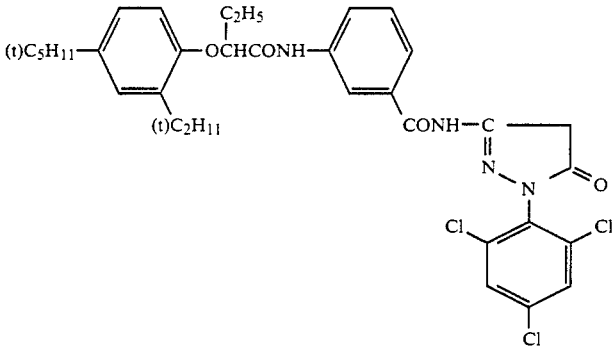
ExM-12
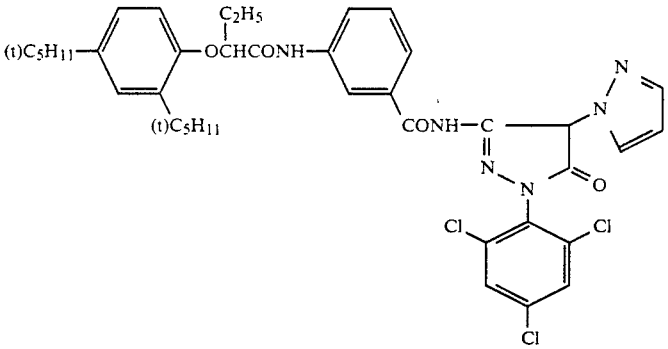
ExM-13
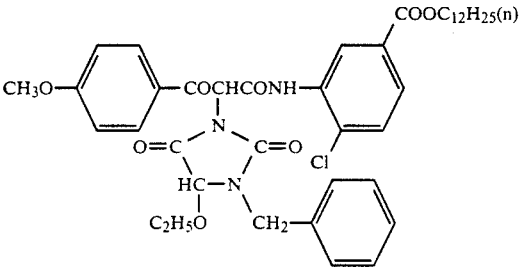
ExY-16

-continued
Cpd-1
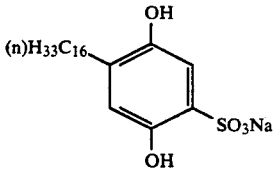
Cpd-2
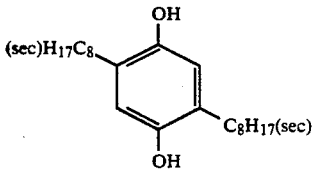
ExS-1
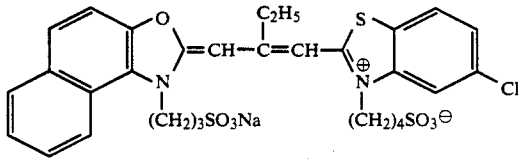
ExS-2
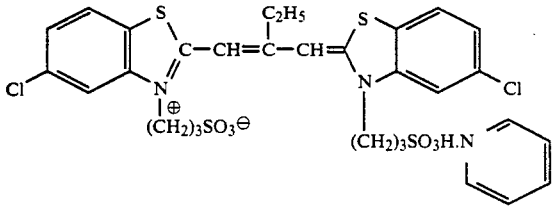
ExS-3
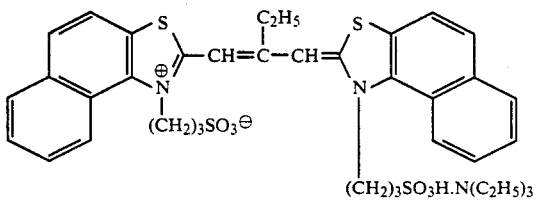
ExS-4
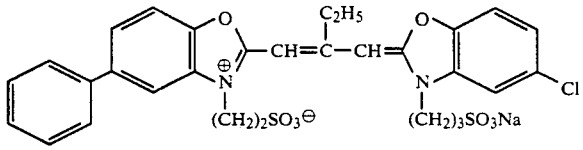
ExS-5
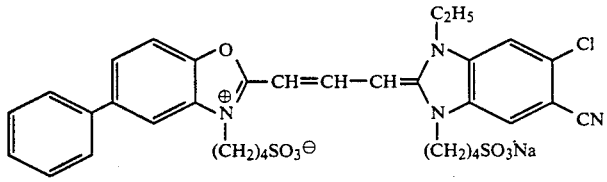
ExS-6
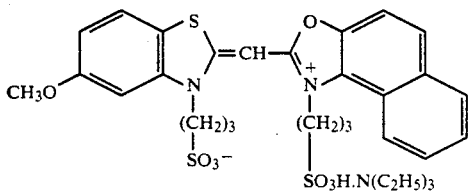

-continued

ExS-7

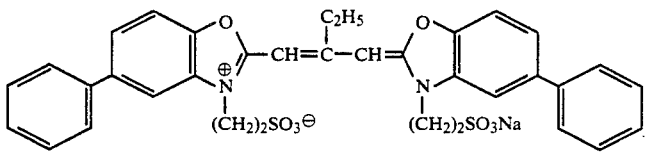

ExS-8

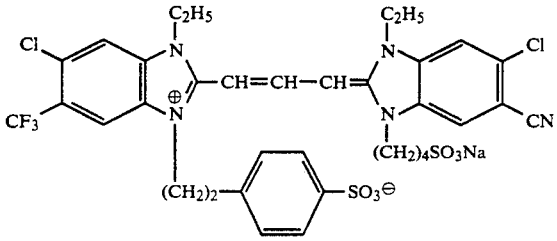

ExS-9

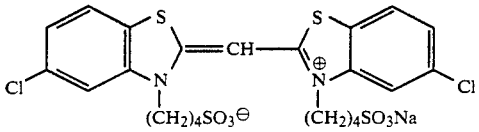

H-1

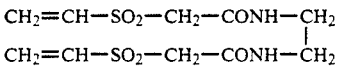

Cpd-3

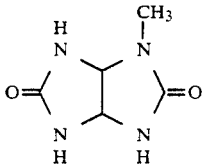

Cpd-4

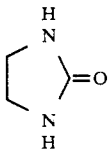

The sample thus obtained was cut into a strip of 35 mm in width and 110 cm in length and after photographing, processed for 4 weeks (real working time=22 days) at 10 strips per day by the processing step shown below using wash water as shown in Example 1.

The processing step was as follows:

| Processing Step | Time | Temperature (°C.) | Replenishing Amount (ml) | Tank Volume (l) |
|---|---|---|---|---|
| Developement | 150 sec. | 40 | 10 | 5 |
| Blix | 180 sec. | 40 | 10 ← | 5 |
| Wash (1) | 20 sec. | 35 | — | 1.5 |
| Wash (2) | 20 sec. | 35 | 10 | 1.5 |
| Stabilization | 20 sec. | 35 | 10 | 1.5 |
| Drying | 50 sec. | 65 | | |

The replenishing amount was per 1 meter of the strip.

A countercurrent system of from Wash (1) to Wash (2) was employed and the overflow liquid from Wash (1) was introduced into the blix solution.

Also, as the processor, Champion 23S Nega Processor FP-350 (made by Fuji Photo Film Co., Ltd.) was modified and used. The amount of blix solution carried by the light-sensitive film into the wash tank was 2 ml per film of 35 mm in width and 1 meter in length.

Then, the compositions of the processing solutions are as follows:

| | Tank Liquid | Replenisher |
|---|---|---|
| Color Developer | | |
| Diethylenetriaminepenta-acetic acid | 2.0 g | 2.2 g |
| 1-Hydroxyethylidene-1,1-diphosphonic acid | 3.0 g | 3.2 g |
| Sodium sulfite | 4.0 g | 5.5 g |
| Potassium carbonate | 30.0 g | 45.0 g |
| Potassium bromide | 1.4 g | — |
| Hydroxylamine sulfate | 3.0 g | 4.5 g |
| Potassium iodide | 1.5 mg | — |
| Compound I-1 | 4.0 g | 5.0 g |
| Triethanolamine | 7.0 g | 8.5 g |
| 4-(N-Ethyl-N-β-hydroxyethyl-amino)-3-methylaniline sulfate | 4.5 g | 7.5 g |
| Water to make | 1000 ml | 1000 ml |
| pH | 10.05 | 10.20 |
| Blix Solution | | |
| Ethylenediaminetetraacetic acid ferric ammonium di-hydrate | 80.0 g | 160.0 g |
| Ethylenediaminetetraacetic acid di-sodium salt | 5.0 g | 10.0 g |
| Sodium sulfite | 12.0 g | 24.0 g |
| Aqueous solution of ammonium | 29.0 g | 500.0 g |

-continued

| | | |
|---|---|---|
| thiosulfate (70%) | | |
| Acetic acid (98%) | 2.0 ml | 5.0 ml |
| Blix accelerator shown below | 0.01 mol | 0.02 mol |

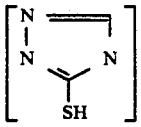

| | | |
|---|---|---|
| Water to make | 1000 ml | 1000 ml |
| pH | 6.5 | 6.5 |

| Stabilization Solution | (Tank liquid and replenisher had same component) |
|---|---|
| Formalin (37%) | 2.0 ml |
| Polyoxyethylene-p-monononylphenyl ether (mean polymerization degree 10) | 0.3 g |
| Ethylenediaminetetraacetic acid di-sodium salt | 0.05 g |
| Water to make | 1000 ml |
| pH | 5.0 to 8.0 |

A part of the replenisher for wash water was added to the color developer. The amount of the replenisher for wash water and the addition system are shown in Table 2 below.

The processing was performed by continuous processing under the same environmental conditions as in Example 1. The open area of the color developer tank was 0.015 $cm^2$/ml. In addition, the working time was 10 hours per day and the evaporation amount of the color developer was 100 ml/day. The change of the minimum density of the cyan images ($\Delta D_{min}$) and the gradation change of the cyan images (AYR) before and after the continuous processing were determined and the results obtained are shown in Table 2.

TABLE 2

| No. | Addition method of solution to color developer, preservative: Added amount of solution per day (ml) | Addition Times | Preservative | Change of photographic property: $\Delta D_{Rmin}$ | $\Delta_{\gamma R}$ |
|---|---|---|---|---|---|
| 1 (Comparison) | — | — | I-1/tri-ethanolamine | +0.05 | +0.12 |
| 2 (Invention) | 300 | Once a week | " | −0.01 | −0.04 |
| 3 (Invention) | 40 | Once per 2 days | " | +0.02 | +0.04 |
| 4 (Invention) | 80 | " | " | +0.01 | +0.01 |
| 5 (Invention) | 120 | " | " | 0.00 | 0.00 |
| 6 (Invention) | 160 | " | " | −0.01 | −0.02 |
| 7 (Invention) | 200 | " | " | −0.02 | −0.05 |
| 8 (Invention) | 20 | Once a day | " | +0.03 | +0.08 |
| 9 (Invention) | 40 | " | " | +0.02 | +0.03 |
| 10 (Invention) | 60 | " | " | +0.01 | +0.01 |
| 11 (Invention) | 80 | " | " | 0.00 | 0.00 |
| 12 (Invention) | 100 | " | " | −0.02 | −0.06 |
| 13 (Invention) | 10 | twice a day | " | +0.03 | +0.09 |
| 14 (Invention) | 20 | " | I-1/tri-ethanolamine | +0.02 | +0.03 |
| 15 (Invention) | 30 | " | " | +0.01 | +0.02 |
| 16 (Invention) | 40 | " | " | 0.00 | 0.00 |
| 17 (Invention) | 50 | " | " | −0.02 | −0.05 |

As is clear from Table 2, by using the processing method of the present invention, there was less deviation in photographic properties. Also, when the replenisher for wash water was added to the color developer in an amount of from 40 ml to 80 ml per day (0.4 to 0.8 times the evaporated amount) (Nos. 4, 5, 6, 9, 10, 11, 14, 15, and 16), stable photographic properties resulted regardless of the number of times the replenisher was added.

EXAMPLE 4

When the same procedure as in Example 3 was used under the same condition as No. 5 in Example 3, except that each of compounds III-7, III-12, III-22 and III-25 was used in place of Compound I 1, excellent photographic performance was obtained.

EXAMPLE 5

A color photographic material having layer 1 to layer 14 on the front surface of a paper support (100 μm in thickness) having polyethylene coating on both surface and layer 15 to layer 16 on the back side thereof was prepared. The polyethylene coating on the emulsion side contained titanium oxide as a white pigment and a slight amount of ultramarine blue as a bluish dye (the chromaticity of the front surface of the support was 88.0, −0.20, and −0.75 as L*, a*, and b* series).

Composition of Layers

The coating amount was shown as g/$m^2$ units of silver for silver halide emulsion and colloid silver, and as g/$m^2$ units for gelatin and additives. The emulsion for each layer was prepared according to the method for Emulsion EM 1 as described later. In this case, however, a Lipman emulsion which had not been subjected to surface chemical sensitization was used as the emulsion for Layer 14.

| | |
|---|---|
| Layer 1 Antihalation Layer | |
| Black colloid layer | 0.10 |
| Gelatin | 0.70 |
| Layer 2 Interlayer | 0.70 |
| Gelatin | |
| Layer 3 Low-speed Red-sensitive Emulsion Layer | |
| Silver bromide spectrally sensitized by red sensitizing dyes (ExS-1, 2, and 3) (mean grain size 0.25 μm, size distribution (coefficient of variation) 8%, octahedron) | 0.04 |
| Silver chlorobromide spectrally sensitized by red sensitizing dyes (ExS-1, 2, and 3) (silver chloride 5 mol %, mean grain size 0.40 μm, size | 0.08 |

-continued

| | |
|---|---|
| distribution 10%, octahedron) | |
| Gelatin | 1.00 |
| Cyan couplers (ExC-1 and 2 equivalent amount) | 0.30 |
| Fading inhibitors (Cpd-1, 2, 3, and 4 equivalent amount) | 0.18 |
| Stain inhibitor (Cpd-5) | 0.003 |
| Coupler dispersion medium (Cpd-6) | 0.03 |
| Coupler solvents (Solv-1, 2, and 3 equivalent amount) | 0.12 |
| Layer 4 High-speed Red-sensitive Emulsion Layer | |
| Silver bromide spectrally sensitized by red sensitizing dyes (ExS-1, 2, and 3) (mean grain size 0.60 μm, size distribution 15%, octahedron) | 0.14 |
| Gelatin | 1.00 |
| Cyan couplers (ExC-1 and 2 equivalent amount) | 0.30 |
| Fading inhibitors (Cpd-1, 2, 3, and 4 equivalent amount) | 0.18 |
| Coupler dispersion medium (Cpd-6) | 0.03 |
| Coupler solvent (Solv-1, 2, and 3 equivalent amount) | 0.12 |
| Layer 5 Interlayer | |
| Gelatin | 1.00 |
| Color mixing inhibitor (Cpd-7) | 0.08 |
| Color mixing inhibitor solvents (Solv-4 and 5 equivalent amount) | 0.16 |
| Polymer latex (Cpd-8) | 0.10 |
| Layer 6 Low-speed Green-sensitive Emulsion Layer | |
| Silver bromide spectrally sensitized by green sensitizing dye (ExS-4) (mean grain size 0.25 μm, size distribution 8%, octahedron) | 0.04 |
| Silver chlorobromide spectrally sensitized by green sensitizing dye (ExS-4) (silver chloride 5 mol %, mean grain size 0.40 μm, size distribution 10%, octahedron) | 0.06 |
| Gelatin | 0.80 |
| Magenta couplers (ExM-1 and 2 equivalent amount) | 0.11 |
| Fading inhibitor (Cpd-9) | 0.10 |
| Stain inhibitors (Cpd-10, 11, 12, and 13/ 10:7:7:1) | 0.025 |
| Coupler dispersion medium (Cpd-6) | 0.05 |
| Coupler solvents (Solv-4 and 6 equivalent amount) | 0.15 |
| Layer 7 High-speed Green-sensitive Emulsion Layer | |
| Silver bromide spectrally sensitized by green sensitizing dye (ExS-4) (mean grain size 0.65 μm, size distribution 16%, octahedron) | 0.10 |
| Gelatin | 0.80 |
| Magenta couplers (ExM-1 and 2 equivalent amount) | 0.11 |
| Fading inhibitor (Cpd-9) | 0.10 |
| Stain inhibitors (Cpd-10, 11, 12, and 13/ 10:7:7:1) | 0.025 |
| Coupler dispersion medium (Cpd-6) | 0.05 |
| Coupler solvents (Solv-4 and 6 equivalent amount) | 0.15 |
| Layer 8 Interlayer | |
| Same as Layer 5. | |
| Layer 9 Yellow Filter Layer | |
| Yellow colloid silver | 0.12 |
| Gelatin | 0.07 |
| Color mixing inhibitor (Cpd-7) | 0.03 |
| Color mixing inhibitor solvents (Cpd-4 and 5 equivalent amount) | 0.10 |
| Polymer latex (Cpd-8) | 0.07 |
| Layer 10 Interlayer | |
| Same as Layer 5. | |
| Layer 11 Low-speed Blue-sensitive Emulsion Layer | |
| Silver bromide spectrally sensitized by blue sensitizing dyes (ExS-5 and 6) (mean grain size 0.40 μm, size distribution 8%, octahedron) | 0.07 |
| Silver chlorobromide spectrally sensitized by blue sensitizing dyes (ExS-5 and 6) (silver chloride 8 mol %, mean grain size 0.60 μm, size distribution 11%, octahedron) | 0.14 |
| Gelatin | 0.80 |
| Yellow coupler (ExY-1) | 0.35 |
| Fading inhibitor (Cpd-14) | 0.10 |
| Stain inhibitors (Cpd-5 and 15 at 1:5) | 0.007 |
| Coupler dispersion medium (Cpd-6) | 0.05 |
| Coupler solvent (Solv-2) | 0.10 |
| Layer 12 High-speed Blue-sensitive Emulsion Layer | |
| Silver bromide spectrally sensitized by blue sensitizing dyes (ExS-5 and 6) (mean grain size 0.85 μm, size distribution 18%, octahedron) | 0.15 |
| Gelatin | 0.60 |
| Yellow coupler (ExY-1) | 0.30 |
| Fading inhibitor (Cpd-14) | 0.10 |
| Stain inhibitors (Cpd-5 and 15 at 1:5) | 0.007 |
| Coupler dispersion medium (Cpd-6) | 0.05 |
| Coupler solvent (Solv-2) | 0.10 |
| Layer 13 Ultraviolet Absorption Layer | |
| Gelatin | 1.00 |
| Ultraviolet absorbents (Cpd-2, 4, and 16 equivalent amount) | 0.50 |
| Color mixing inhibitors (Cpd-7 and 17 equivalent amount) | 0.03 |
| Dispersion medium (Cpd-6) | 0.02 |
| Ultraviolet absorbent solvents (Solv-2 and 7 equivalent amount) | 0.08 |
| Irradiation inhibiting dyes (Cpd-18, 19, 20, and 21 at 10:10:13:15) | 0.04 |
| Layer 14 Protective Layer | |
| Fine grain silver chlorobromide (silver chloride 97 mol %, mean grain size 0.2 μm) | 0.03 |
| Acryl-modified copolymer of polyvinyl alcohol | 0.01 |
| Polymethyl methacrylate particles (mean particle size 2.4 μm) and silicon oxide (mean particle size 5 μm) equivalent amount | 0.05 |
| Gelatin | 0.18 |
| Gelatin hardening agents (H-1 and 2 equivalent amount) | 0.18 |
| Layer 15 Back Layer | 2.50 |
| Gelatin | |
| Layer 16 Back Surface Protective Layer | |
| Polymethyl methacrylate particles (mean particle size 2.4 μm) and silicon oxide (mean particle size 5 μm) equivalent amount | 0.05 |
| Gelatin | 2.00 |
| Gelatin hardening agents (H-1 and 2 equivalent amount) | 0.14 |

Preparation of Emulsion EM-1

An aqueous solution of potassium bromide and an aqueous solution of silver nitrate were simultaneously added to an aqueous gelatin solution with vigorous stirring at 75° C. over a period of 15 minutes to provide an emulsion of octahedral silver bromide grains having a mean grain size of 0.40 μm. To the emulsion were successively added 3 g of 3,4-dimethyl-1,3-thiazoline-2-thione, 6 mg of sodium thiosulfate, and 7 mg of chloroauric acid (tetra-hydrate) and the mixture was heated to 75° C. for 80 minutes to perform chemical sensitization treatment. Then, the silver halide grains growth was further performed by the same precipitation condition as above with the grains thus obtained as cores to finally provide an octahedral mono-dispersed core/-shell silver bromide emulsion having a mean grain size of 0.7 μm. The coefficient of variation of the grain sizes was about 10%. To the emulsion were added 1.5 mg of sodium thiosulfate and 1.5 mg of chloroauric acid (tetra-hydrate) per mol of silver and they are heated to 60° C. for 60 minutes to perform chemical sensitization treatment to provide a inside latent image type silver halide emulsion.

For each silver halide emulsion layer were used nucleating agents ExZK-1 and ExZK-2 each in an amount of $10^{-3}$% by weight and a nucleation accelerator Cpd-22 in an amount of $10^{-2}$% by weight. Furthermore, for each layer were used Alkanol XC (made by Du Pont) and a sodium alkylbenzenesulfonate as emulsion-dispersion aids and succinic acid ester and Magefac F-120 (made by Dainippon Ink and Chemicals, Inc.) as coating aids. Also, for the layers containing silver halide or colloid silver were used Cpd-23, 24, and 25 as stabilizers.

The compounds used in the above layers are shown below:

ExS-1

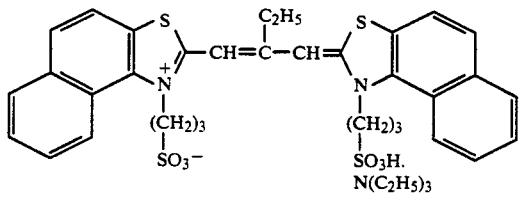

ExS-2

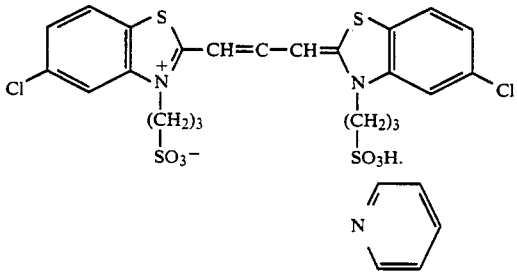

ExS-3

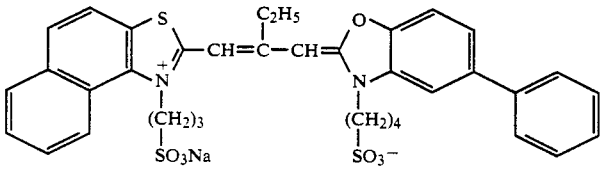

ExS-4

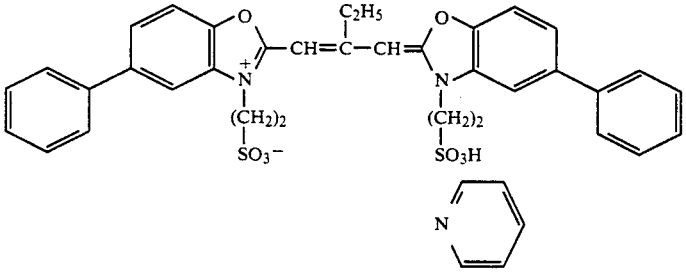

ExS-5

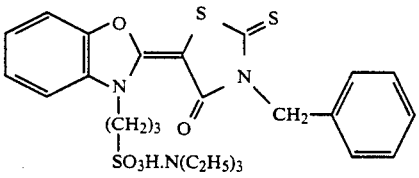

ExS-6

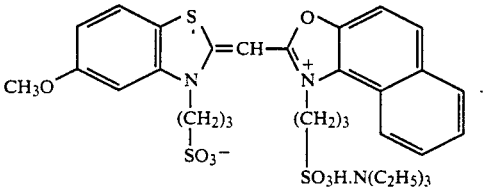

-continued
Cpd-1
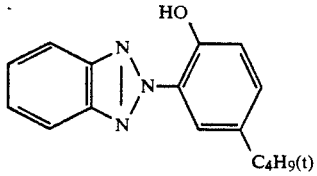
Cpd-2
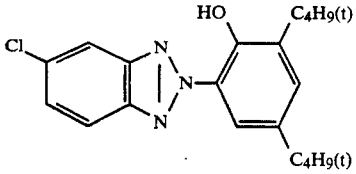
Cpd-3
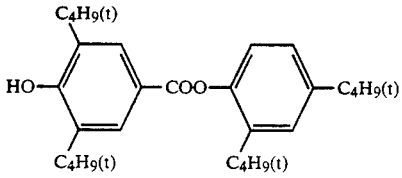
Cpd-4
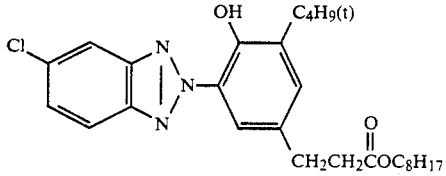
Cpd-5
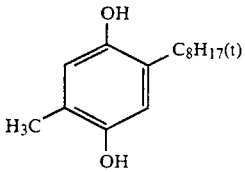
Cpd-6
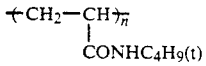
n = 100 to 1000
Cpd-7
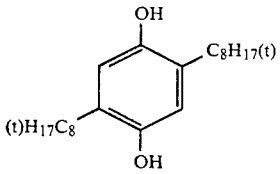
Cpd-8
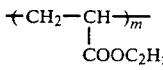
Cpd-9
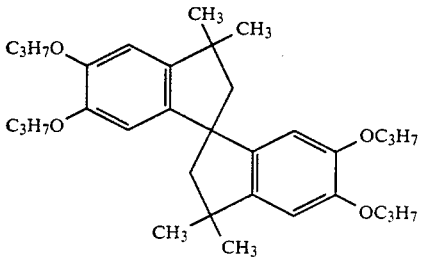

-continued
Cpd-10
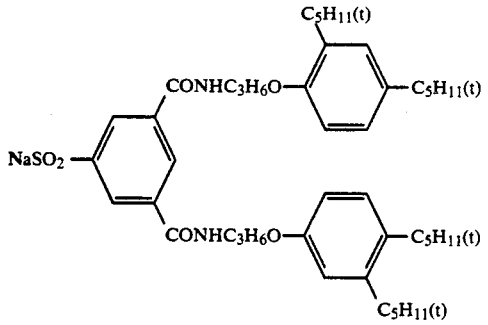
Cpd-11
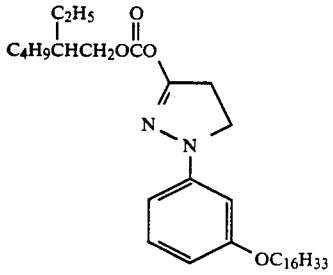
Cpd-12
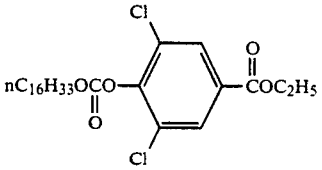
Cpd-13
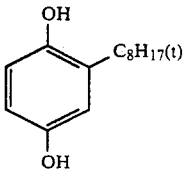
Cpd-14
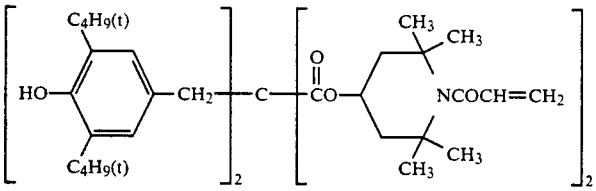
Cpd-15
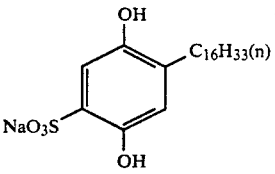
Cpd-16
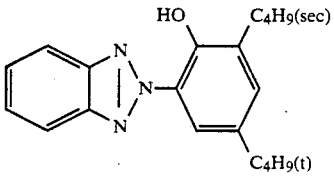

-continued
Cpd-17
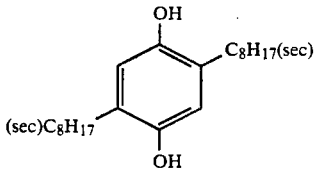
Cpd-18
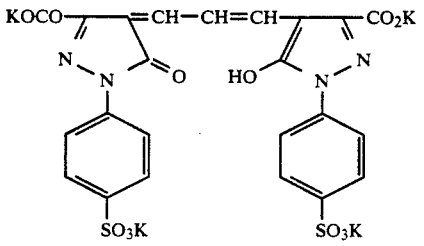
Cpd-19
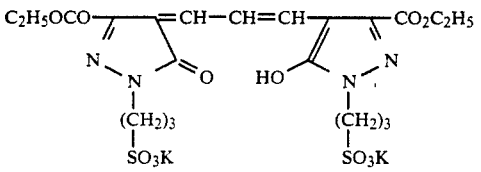
Cpd-20
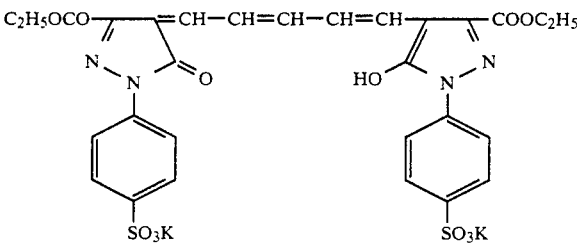
Cpd-21
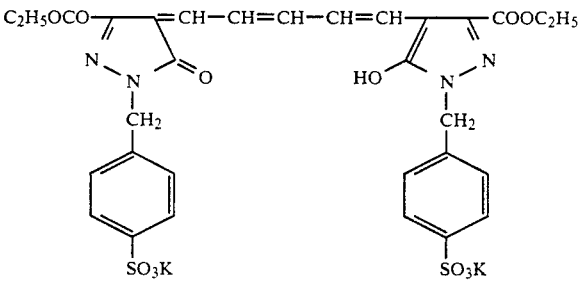
Cpd-22
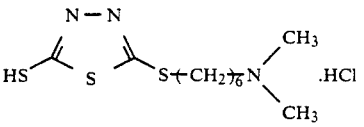
Cpd-23
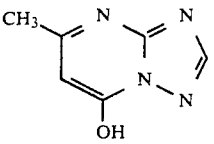
Cpd-24
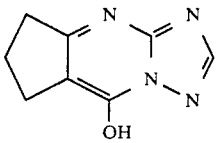

-continued
Cpd-25
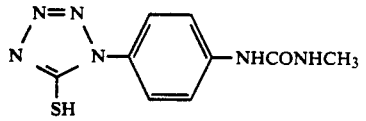
ExC-1
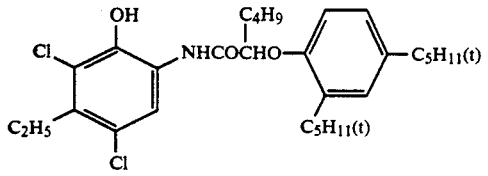
ExC-2
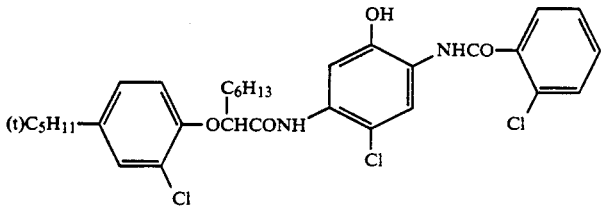
ExM-1
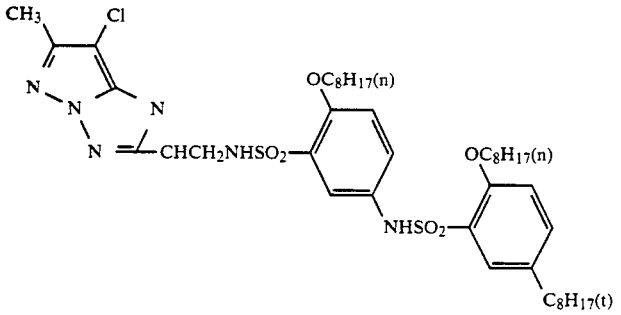
ExM-2
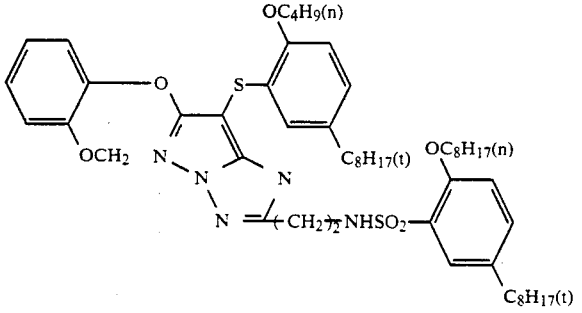
ExY-1
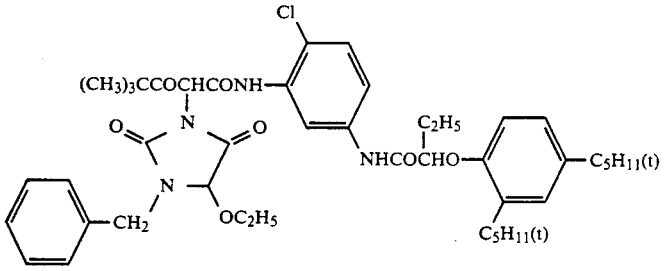
Solv-1:
Di(2-ethylhexyl)sebacate
Solv-2:
Trinonyl Phosphate
Solv-3:
Di(3-methylhexyl) Phthalate
Solv-4:

-continued

Tricresyl Phosphate

Solv-5:
Dibutyl Phthalate

Solv-6:
Trioctyl Phosphate

Solv-7:
Di(2-ethylhexyl) Phthalate

H-1:
1,2-Bis(vinylsulfonylacetamido)ethane

H-2:
4,6-Dichloro-2-hydroxy-1,3,5-triazine sodium salt

ExZK-1:
7-[3-(5-Mercaptotetrazol-1-yl)benzamido]-10-propal-1,2,3,4-tetrahydrocoumaridinium Perchlorate ExZK-2:
1-Hormyl-2-{4-[3-(3-[3-(5-mercaptotetrazol-1-yl)phenyl]ureido) benzsulfonamido]phenyl}hydrazine The silver halide color photographic material (Sample 401) prepared as above was imagewise exposed and subjected to continuous processing by the following steps using an automatic processor at 0.6 $m^2$ per day until the accumulated amount of the replenisher for the color developer became 1.5 times the tank volume.

| Processing Step | Time | Temperature (°C.) | Tank Volume (l) | Replenisher ($ml/m^2$) |
|---|---|---|---|---|
| Color Development | 90 sec. | 38 | 8 | 300 |
| Blix | 40 sec. | 33 | 3 | 300 |
| Wash (1) | 40 sec. | 33 | 3 | — |
| Wash (2) | 40 sec. | 33 | 3 | — |
| Wash (3) | 15 sec. | 33 | 0.5 | 320 |
| Drying | 30 sec. | 80 | | |

A so-called countercurrent replenishing system was used as the replenishing system for wash water. In this system, the replenisher was supplied to Wash Bath (3), the overflow liquid from Wash Bath (3) was introduced into Wash Bath (2), and the overflow liquid from Wash Bath (2) was introduced into Wash Bath (1). In this case, the amount of the blix solution carried by the light-sensitive material from the blix bath into Wash Bath (1) was 35 $ml/m^2$ and the amount of the replenisher for wash water was 9.1 times the carried amount of the blix solution.

The compositions of the processing solutions were as follows.

| Color Developer | Mother Liquor | Replenisher |
|---|---|---|
| Ethylenediaminetetrakis-methylenephosphonic acid | 0.5 g | 0.5 g |
| Diethylene glycol | 10 ml | 10 ml |
| Benzyl alcohol | 12.0 ml | 14.4 ml |
| Potassium bromide | 0.65 g | — |
| Sodium sulfite | 2.4 g | 2.9 g |
| Compound III-7 | 4.0 g | 4.8 g |
| Triethanolamine | 4.0 g | 4.8 g |
| N-Ethyl-N-(β-methanesulfonamidoethyl)-3-methylaniline sulfate | 5.6 g | 6.6 g |
| Potassium carbonate | 27.0 g | 25.0 g |
| Optical whitening agent (diaminostilbene series) | 1.0 g | 1.2 g |
| Water to make | 1000 ml | 1000 ml |
| pH (25° C.) | 10.50 | 10.80 |

-continued

| Blix Solution | Mother Liquor | Replenisher |
|---|---|---|
| Ethylenediaminetetraacetic acid di-sodium di-hydrate | 4.0 g | Same as the mother liquor |
| Ethylenediaminetetraacetic acid Fe(III) ammonium di-hydrate | 46.0 g | |
| Sodium thiosulfate (700 g/l) | 155 ml | |
| Sodium p-methylbenzenesulfinate | 20 g | |
| Sodium hydrogensulfite | 12 g | |
| 2-Amino-5-mercapto-1,3,4-thiadiazole | 0.45 g | |
| Ammonium nitrate | 30.0 g | |
| Water to make | 1000 ml | |
| pH (25° C.) | 6.20 | |

Wash Water

Same as in Example 1

Then, the same continuous processing as above was performed while using the stabilizer solution (A) instead of wash water, the stabilizer solution (A) having the following composition in place of the wash water.

Stabilizer Solution A (Mother liquid and replenisher had same composition)

| | |
|---|---|
| 1-Hydroxyethylidene 1,1-diphosphonic acid (60%) | 1.6 ml |
| Bismuth chloride | 0.3 g |
| Polyvinylpyrrolidone | 0.3 g |
| Aqueous ammonia (26%) | 2.5 ml |
| Nitrilotriacetic acid | 1.0 g |
| 5-Chloro-2-methyl-4-isothiazolin-3-one | 0.05 g |
| 2-Octyl-4-isothiazoline | 0.05 g |
| Optical whitening agent (4,4'-diaminostilbene series) | 1.0 g |
| Water to make | 1000 ml |
| pH (25° C.) | 7.5 |

Then, following the same method as above (for Stabilizer Solution A), except that sodium hydroxide was used in place of aqueous ammonia (26%), stabilizer solution B was prepared as a substitute for wash water, and the continuous processing was performed using the stabilizer solution B.

The change of the photographic properties before and after the continuous processing was determined as in Example 1. The open area of the automatic processor used in this example was 0.005 $cm^2/ml$ and the evaporated amount was 60 ml/day under the same conditions as in Example 1.

Then, the continuous processing was further performed while adding the replenisher for wash water and the replenisher for the stabilization solution as a substitution for wash water and then the change of the photographic properties was determined. The results obtained are shown in Table 3.

As is clear from Table 3, the method of the present invention, resulted in less deviation of photographic performance in the continuous processing. In addition, when the processing is performed using Stabilizer solution A containing aqueous ammonia (26%), the change of the minimum density was slightly large, an inferior result when compared to the case of using Stabilization solution B containing no aqueous ammonia. It is believed that the inferior result was due to fog formed by ammonia in the stabilizer solution.

TABLE 3

| | Solution addition method | | | Change of photographic property | | |
|---|---|---|---|---|---|---|
| | Added amount | | | | | |
| No. | Added solution | (ml) | Added times | $\Delta D_{Gmin}$ | $\Delta D_{Gmax}$ | $\Delta CB_{1.0}$ |
| 1 (Comparison) | — | — | — | +0.07 | +0.15 | −0.15 |
| 2 (Comparison) | — | — | — | +0.07 | +0.16 | −0.14 |
| 3 (Comparison) | — | — | — | +0.08 | +0.17 | −0.15 |
| 4 (Invention) | Wash water | 30 | Once a day | +0.01 | −0.01 | −0.02 |
| 5 (Invention) | Stabilizer A | 30 | Once a day | +0.05 | +0.10 | +0.08 |
| 6 (Invention) | Stabilizer B | 30 | Once a day | +0.02 | +0.02 | −0.03 |

EXAMPLE 6

By following the same procedure as Example 5 except that each of compounds I-1, I-2, II-2, III-12, III-22, IV-8, and V-1 was used in place of Compound III-7 while adding the water replenisher solution to the color developer, the deviation of the photographic properties by continuous processing was less and good results were also obtained.

While the invention has been described in detail and with reference to specific embodiments thereof, it will be apparent to one skilled in the art that various changes and modifications can be made therein without departing from the spirit and scope thereof.

What is claimed is:

1. A method of continuously processing an imagewise exposed silver halide photographic material using an automatic processor which has a color development bath, comprising the steps of a) developing with a color developer containing an aromatic primary amine color developing agent in an amount of from 0.1 to 20 g per liter and an organic preservative in an amount of from 0.005 to 0.5 mol per liter, and b) adding to the color developer during the continuous processing (i) a replenisher for the color developer containing an aromatic primary amine color developing agent and other components for the development to compensate for active components consumed in the development in an amount of from 20 ml to 600 ml per $m^2$ of the photographic material processed, and (ii) a water solution containing water as a main component in an amount of from 0.1 to 1.2 times the amount of the developer which has evaporated from the bath at a frequency of about once per week or more often, wherein said water solution is added independent of the replenisher, and said continuous processing is carried out for a period of time exceeding one week.

2. A method as in claim 1, wherein the amount of the water solution added to the color developer bath is from 0.3 to 0.9 times the amount of the developer which has evaporated.

3. A method as in claim 1, wherein the amount of the organic preservative added to the color developer solution is from 0.03 mol/liter to 0.1 mol/liter of the color developer solution.

4. A method as in claim 1, wherein the organic preservative is selected from the group consisting of substituted hydroxylamines, hydroxamic acids, hydrazines, hydrazides, phenols α-hydroxyketones, α-aminoketones, saccharides, monoamines, diamines, polyamines, quaternary ammonium salts, nitroxy radicals, alcohols, oximes, diamido compounds, and condensed ring amines.

5. A method as in claim 4, wherein the organic preservative comprises (i) at least one compound selected from the group consisting of the substituted hydroxylamines, the hydroxamic acids, the hydrazines, the hydrazides, the phenols, the α-hydroxyketones, the α-aminoketones and the saccharides, and (ii) at least one compound selected from the group consisting of the monoamines, the diamines, the polyamines, the quaternary ammonium salts, the nitroxy radicals, the alcohols, the oximes, the diamino compounds and the condensed ring amines.

6. A method as in claim 4, wherein the organic preservative comprises (i) one compound selected from the group consisting of the substituted hydroxylamines, the hydrazines and the hydrazides, and at least (ii) one compound selected from the group consisting of the monoamine and the condensed ring amine compounds.

7. A method as in claim 4, wherein the organic preservative comprises one of the substituted hydroxylamine compounds and one of the monoamine compounds.

8. A method as in claim 1, wherein the water solution added to the developer is water.

9. A method as in claim 1, wherein the water solution is added to the developer at a frequency of about once per day or more often.

10. A method as in claim 1, further comprising bleaching in a bath having a bleaching ability, fixing in a bath having a fixing ability, and washing in at least one of a water washing bath and a stabilization bath.

11. A method as in claim 10, wherein a two tank countercurrent system is used for the washing step, and a water replenisher solution or a replenisher of a stabilization solution is added thereto in an amount of from 300 ml to 1,000 ml per square meter of the light-sensitive material processed.

12. A method as in claim 10, wherein a three tank countercurrent system is used for the washing step, and a water replenisher solution or a replenisher of a stabilization solution is added thereto in an amount of from 100 ml to 500 ml per square meter of the light-sensitive material processed.

13. A method as in claim 10, wherein a four tank countercurrent system is used for the washing step, and a water replenisher solution or a replenisher of a stabilization solution is added thereto in an amount of from 50 ml to 300 ml per square meter of the light-sensitive material processed.

14. A method as in claim 10, wherein the pH of the wash water or the stabilization solution is from 4 to 9.

15. A method as in claim 10, wherein the time for water washing or stabilization is from 10 seconds to 4 minutes.

16. A method as in claim 15, wherein the time for water washing or stabilization is from 20 seconds to 2 minutes.

17. A method as in claim 10, wherein the temperature of the water washing bath or stabilization bath is from 20° C. to 50° C.

18. A method as in claim 17, wherein the temperature of the water washing bath or stabilization bath is from 25° C. to 45° C.

19. A method as in claim 10, wherein the water solution added to the developer is a water replenisher solution for replenishing the water washing bath.

20. A method as in claim 10, wherein the water solution added to the developer is a replenisher of a stabilization solution for replenishing the stabilization bath.

21. A method as in claim 10, wherein the bleaching and fixing steps are carried out in a combined blix bath.

22. A method as in claim 10, further comprising adding a water replenisher solution to the water washing bath or a replenisher of a stabilization solution to the stabilization bath in an amount of from 1 to 50 times by volume the amount of processing solution carried over from a prebath thereof.

23. A method as in claim 22, wherein the amount of the water replenisher solution added to the water washing bath or the amount the replenisher of the stabilization solution added to the stabilization bath is from 3 to 20 times by volume the amount of processing solution carried over from a prebath thereof.

* * * * *